US011600253B2

(12) United States Patent
Izumi

(10) Patent No.: US 11,600,253 B2
(45) Date of Patent: Mar. 7, 2023

(54) ELECTRONIC PERCUSSION INSTRUMENT, ELECTRONIC MUSICAL INSTRUMENT, INFORMATION PROCESSING DEVICE, AND INFORMATION PROCESSING METHOD

(71) Applicant: Roland Corporation, Shizuoka (JP)

(72) Inventor: Seiya Izumi, Shizuoka (JP)

(73) Assignee: Roland Corporation, Shizuoka (JP)

( * ) Notice: Subject to any disclaimer, the term of this patent is extended or adjusted under 35 U.S.C. 154(b) by 260 days.

(21) Appl. No.: 17/012,003

(22) Filed: Sep. 3, 2020

(65) Prior Publication Data

US 2021/0118417 A1 Apr. 22, 2021

(30) Foreign Application Priority Data

Oct. 18, 2019 (JP) ..... JP2019-191583

(51) Int. Cl.

| | |
|---|---|
| ***G10H 1/057*** | (2006.01) |
| ***G10H 1/00*** | (2006.01) |
| ***G10H 1/34*** | (2006.01) |
| ***G10D 13/10*** | (2020.01) |

(52) U.S. Cl.

CPC ..... *G10H 1/057* (2013.01); *G10D 13/26* (2020.02); *G10H 1/0008* (2013.01); *G10H 1/34* (2013.01); *G10H 2250/025* (2013.01)

(58) Field of Classification Search

CPC ..... G10H 1/057; G10H 1/0008; G10H 1/34; G10H 2250/025; G10D 13/26

USPC ..... 84/627

See application file for complete search history.

(56) References Cited

U.S. PATENT DOCUMENTS

| | | | | |
|---|---|---|---|---|
| 4,205,582 A * | 6/1980 | Howell | G10H 1/057 984/322 |
| 5,109,746 A * | 5/1992 | Takauji | G10H 7/12 84/626 |
| 5,147,970 A * | 9/1992 | Obata | G10H 3/125 84/738 |
| 5,438,529 A * | 8/1995 | Rosenberg | G10H 1/344 708/131 |
| 5,786,541 A * | 7/1998 | Komano | G10H 5/007 84/663 |

(Continued)

FOREIGN PATENT DOCUMENTS

| | | |
|---|---|---|
| CH | 643080 A5 * | 5/1984 |
| DE | 3325304 C2 * | 1/1991 |

(Continued)

*Primary Examiner* — Christina M Schreiber
(74) *Attorney, Agent, or Firm* — JCIPRNET

(57) ABSTRACT

An electronic percussion instrument, electronic musical instrument, information processing device, and information processing method are provided. The electronic musical instrument includes a control device that performs processing in which an envelope indicating a change in a reference value over time for determining whether vibration of the second playing operation element is self-induced vibration or excited vibration entailed by vibration of the first playing operation element is generated based on a waveform indicating vibration of the first playing operation element, and processing in which information on the basis of excited vibration of the second playing operation element is prevented from being included in information indicating operation of the second playing operation element using the reference value indicated by the envelope.

20 Claims, 18 Drawing Sheets

(56) References Cited

U.S. PATENT DOCUMENTS

| | | | | |
|---|---|---|---|---|
| 8,030,566 | B2 * | 10/2011 | Ludwig | G06F 3/005 84/622 |
| 11,211,038 | B2 * | 12/2021 | Van Den Broeck | G10D 13/02 |
| 2004/0025663 | A1 * | 2/2004 | Harada | G10D 13/02 84/104 |
| 2004/0255765 | A1 * | 12/2004 | Mori | G10H 3/146 84/742 |
| 2005/0257672 | A1 * | 11/2005 | Arimoto | G10H 7/008 84/738 |
| 2020/0234683 | A1 * | 7/2020 | Takasaki | G10H 1/02 |
| 2021/0118417 | A1 * | 4/2021 | Izumi | G10H 1/34 |

FOREIGN PATENT DOCUMENTS

| | | | | | |
|---|---|---|---|---|---|
| GB | 1565122 | A | * | 4/1980 | G10H 1/055 |
| JP | H0580754 | A | * | 4/1993 | |
| JP | H0695671 | A | * | 4/1994 | |
| JP | H07069687 | | | 7/1995 | |
| JP | 2013145262 | | | 7/2013 | |

* cited by examiner

ELECTRONIC PERCUSSION INSTRUMENT, ELECTRONIC MUSICAL INSTRUMENT, INFORMATION PROCESSING DEVICE, AND INFORMATION PROCESSING METHOD

CROSS-REFERENCE TO RELATED APPLICATION

This application claims the priority of Japan patent application serial no. 2019-191583, filed on Oct. 18, 2019. The entirety of the above-mentioned patent application is hereby incorporated by reference herein and made a part of this specification.

BACKGROUND

Field of the Invention

The disclosure relates to an electronic percussion instrument, an electronic musical instrument, an information processing device, and an information processing method.

Description of the Related Art

Electronic musical instruments having a plurality of playing operation elements which vibrates individually include electronic percussion instruments and electronic string instruments. For example, an electronic percussion instrument has a plurality of percussive surfaces (which will also be referred to as striking surfaces) as a plurality of playing operation elements. In electronic musical instruments, due to the structure thereof, there may be cases in which if a stroke is applied to a certain percussive surface, vibration on this percussive surface (which will be referred to as self-induced vibration) is transferred to other percussive surfaces and causes vibration (which will be referred to as excited vibration) thereon so that a sensor may erroneously detect the excited vibration as a stroke and erroneous sound generation (which will be referred to as crosstalk) may occur.

In the related art, there is a technology in which an amount of vibration in a playing operation element is detected, a largest value of the amount of vibration is stored, a reference value corresponding to a virtual quasi-envelope curve similar to an envelope curve of actual vibration of the playing operation element generated based on this largest value and the amount of vibration are compared to each other, and generation of musical sound is instructed (for example, refer to Japanese Patent Publication No. H7-69687). Processing for preventing such erroneous sound generation caused by crosstalk received from other percussive surfaces is referred to as crosstalk cancellation (for example, Japanese Patent Laid-Open No. 2013-145262).

PATENT DOCUMENTS

[Patent Document 1] Japanese Patent Publication No. H7-69687

[Patent Document 2] Japanese Patent Laid-Open No. 2013-145262

However, in the patent literature in the related art, there is no disclosure or implication regarding crosstalk cancellation applied to an electronic percussion instrument having two percussive surfaces directed in directions opposite to each other. That is, applying crosstalk cancellation to an electronic percussion instrument having two percussive surfaces directed in directions opposite to each other is not yet known.

In addition, the technology disclosed in Japanese Patent Publication No. H7-69687 has a problem as follows. As a way of playing a percussion instrument, there is a way of playing that is so-called "simultaneous striking" in which a plurality of percussive surfaces is hit simultaneously. In simultaneous striking, although a player intends to hit percussive surfaces simultaneously, there may be a deviation between timings of hitting the percussive surfaces due to a cause such as the skill or the like of the player. In addition, there are also cases of continuously striking two percussive surfaces during a short period of time.

In the technology disclosed in Japanese Patent Publication No. H7-69687 (technology in the related art), a change in a reference value over time indicates a waveform which attenuates gradually with the elapse of time. In such a waveform, there is concern that a stroke on another percussive surface at a timing later than a timing of a stroke on a certain percussive surface may be erroneously canceled as crosstalk.

The problem of such erroneous crosstalk cancellation is not limited to electronic percussion instruments and is also a problem common in electronic musical instruments (for example, electronic string instruments) other than electronic percussion instruments having a plurality of playing operation elements in which excited vibration (crosstalk) is generated.

SUMMARY

According to an embodiment of the disclosure, there is provided an electronic musical instrument including a first playing operation element and a second playing operation element. The electronic musical instrument includes a control device that performs processing of generating an envelope indicating a change in a reference value over time based on a waveform indicating vibration of the first playing operation element, wherein the reference value is for determining whether vibration of the second playing operation element is self-induced vibration or excited vibration entailed by vibration of the first playing operation element, and performs processing of not including information on a basis of excited vibration of the second playing operation element in information indicating operation of the second playing operation element by using the reference value indicated by the envelope. The envelope indicates an increase in the reference value during a first period from a starting time point to a first time point and indicates a decrease in the reference value during a second period from the first time point to an ending point.

The electronic musical instrument according to the embodiment of the disclosure may employ a configuration in which after comparison is performed every predetermined time point between a level of a waveform indicating vibration of the second playing operation element and a comparison target level set by adding the reference value at the corresponding time point indicated by the envelope to a threshold, the control device scans a waveform exceeding the comparison target level and does not scan any waveform not exceeding the comparison target level.

In addition, in the electronic musical instrument according to the embodiment of the disclosure, a value of the reference value at the starting time point may be configured to be a value obtained by multiplying a largest vibration value at the first time point by a predetermined coefficient. In addition, the electronic musical instrument is an electronic percussion instrument and may employ a configuration in which the first playing operation element and the second playing operation element are a first percussive surface and a second percussive surface, respectively. In this case, the second percussive surface may employ a configuration of being directed in a direction opposite to a direction of the first percussive surface. In addition, the first percussive surface may employ a configuration of being joined to the second percussive surface with a joint part therebetween.

According to another embodiment of the disclosure, there is provided an information processing device for an electronic musical instrument including a first playing operation element and a second playing operation element, the information processing device including:

a control device that performs processing of generating an envelope indicating a change in a reference value over time based on a waveform indicating vibration of the first playing operation element, wherein the reference value is for determining whether vibration of the second playing operation element is self-induced vibration or excited vibration entailed by vibration of the first playing operation element, and performs processing of not including information on a basis of excited vibration of the second playing operation element in information indicating operation of the second playing operation element by using the reference value indicated by the envelope.

According to another embodiment of the disclosure, there is provided an information processing method performed by a control device of an electronic musical instrument including a first playing operation element and a second playing operation element, the information processing method including:

generating an envelope indicating a change in a reference value over time based on a waveform indicating vibration of the first playing operation element, wherein the reference value is for determining whether vibration of the second playing operation element is self-induced vibration or excited vibration entailed by vibration of the first playing operation element; and not including information on a basis of excited vibration of the second playing operation element in information indicating operation of the second playing operation element by using the reference value indicated by the envelope.

The embodiment of the disclosure may include an information processing device, an information processing method, a program, and a storage medium storing the program for the electronic percussion instrument described above. In addition, the embodiment of the disclosure may include an information processing device, an information processing method, a program, and a storage medium storing the program of the electronic musical instrument described above.

DESCRIPTION OF THE EMBODIMENT

The disclosure provides an electronic percussion instrument, an electronic musical instrument, an information processing device, and an information processing method capable of executing more appropriate crosstalk cancellation.

Hereinafter, an embodiment will be described with reference to the drawings. The configuration of the embodiment is an exemplification, which is not limited to the configuration of the embodiment.

<Configuration of Electronic Musical Instrument>

Figure 1:
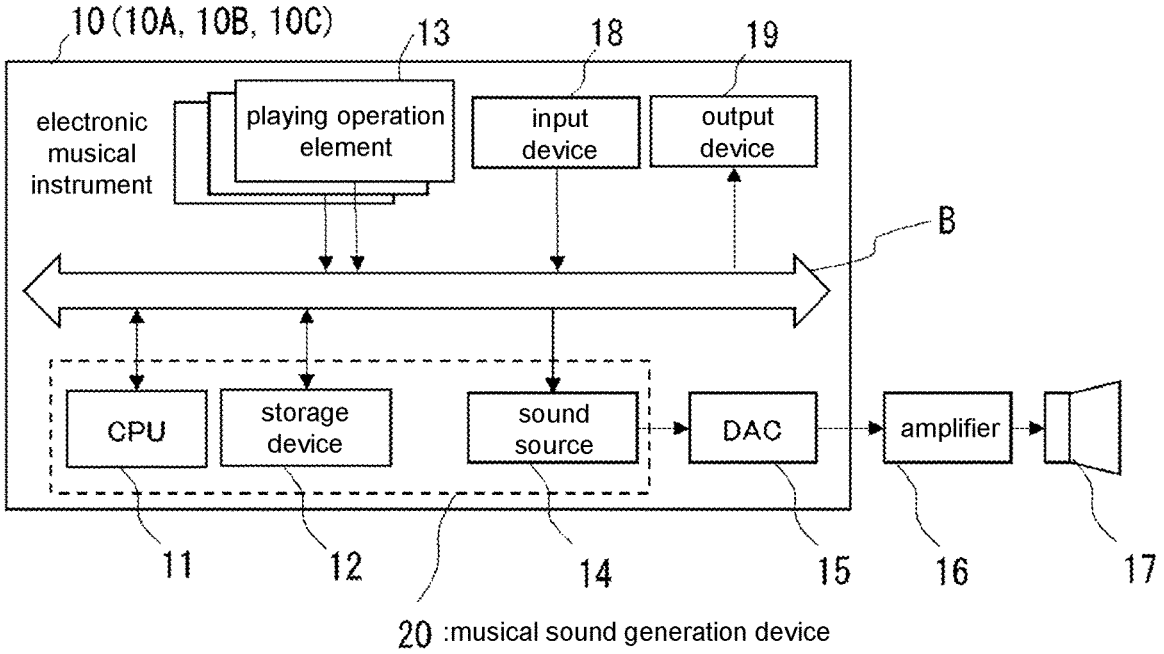
FIG. 1 shows an example of a circuit configuration of an electronic musical instrument according to an embodiment.

FIG. 1 shows an example of a circuit configuration of an electronic musical instrument according to an embodiment. The electronic musical instrument according to this embodiment is an electronic musical instrument having a plurality of playing operation elements which vibrates. The electronic musical instrument having a plurality of playing operation elements which vibrates includes at least an electronic percussion instrument and an electronic string instrument.

In FIG. 1, an electronic musical instrument 10 includes a central processing unit (CPU, which will also be referred to as an MPU) 11, a storage device 12, a plurality of playing operation elements 13, a sound source 14, an input device 18, and an output device 19, which are connected to each other via a bus B.

A digital analog converter (DAC) 15 is connected to the sound source 14, the DAC 15 is connected to an amplifier 16, and the amplifier 16 is connected to a speaker 17. The CPU 11, the storage device 12, and the sound source 14 operate as a musical sound generation device 20. The CPU 11 is an example of "a control unit", "a control device", or "a processor".

The storage device 12 includes a main storage device and an auxiliary storage device. The main storage device is used as a storage domain for a program or data, a working domain of the CPU 11, or the like. For example, the main storage device is formed to have a random access memory (RAM) or in a combination of a RAM and a read only memory (ROM). The auxiliary storage device is used as a storage domain for a program or data, a waveform memory for storing waveform data, or the like. For example, the auxiliary storage device is a flash memory, a hard disk, a solid state drive (SSD), an electrically erasable programmable read-only memory (EEPROM), or the like.

The input device 18 includes operation elements such as keys, buttons, and knobs. The input device 18 is used for inputting various kinds of information and data to the electronic musical instrument 10. The information and data include data for performing various kinds of setting in the electronic musical instrument 10. For example, the output device 19 is a display, which displays information such as parameters set for the electronic musical instrument 10.

The plurality of playing operation elements 13 is percussive surfaces when the electronic musical instrument 10 is an electronic percussion instrument and is a plurality of strings when the electronic musical instrument 10 is an electronic string instrument.

The CPU 11 performs various kinds of processing by executing the program stored in the storage device 12. For example, the CPU 11 generates a stroke waveform in accordance with operation of the playing operation elements 13 and performs sound generation processing of musical sound using musical sound data and the sound source 14. When generating a musical sound signal, the CPU 11 performs processing of avoiding erroneous sound generation (which will be referred to as crosstalk cancellation (XTC) processing) caused by excited vibration which occurs due to vibration transferred from other playing operation elements 13 for each of the playing operation elements 13.

The sound source 14 is a PCM sound source-type sound source circuit having a built-in waveform memory. The CPU 11 stores stroke waveform information after XTC processing in the waveform memory, reads tone information corresponding to the struck percussive surface from the storage device 12, and supplies the read tone information to the sound source 14. The sound source 14 generates and outputs a musical sound signal mimicking that of a percussion instrument (a Japanese drum, a bus drum, a tam-tam, a snare drum, hi-hat opening, hi-hat closing, or the like) through sound generation processing using the stroke waveform and the tone information. A musical sound signal emitted from the sound source 14 is supplied to the DAC 15, is converted into an analog signal, is amplified by the amplifier 16, and is emitted as sound from the speaker 17. An information processing device of the electronic musical instrument 10 includes at least the CPU 11 and the storage device 12. The processing executed by the CPU 11 may be performed by a processor (a DSP or the like) other than a CPU, or an integrated circuit (an ASIC, an FPGA, or the like).

Figure 2:
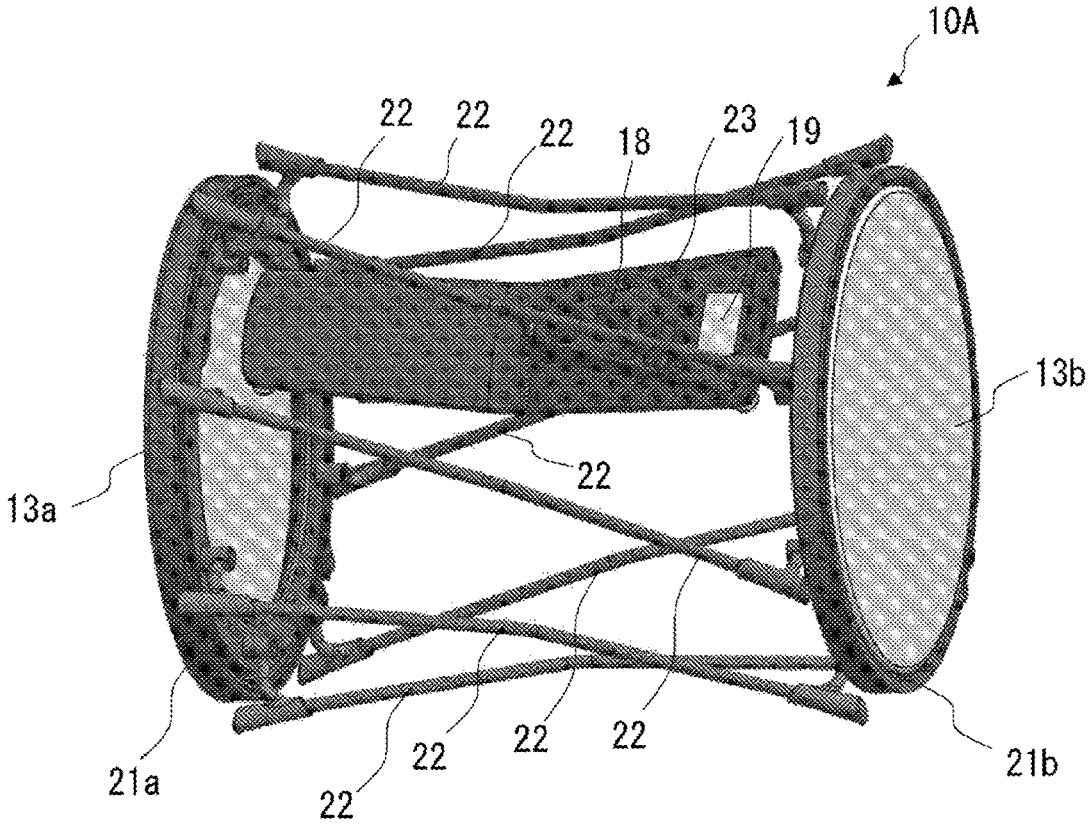
FIG. 2 shows an example of an electronic percussion instrument.
Figure 3:
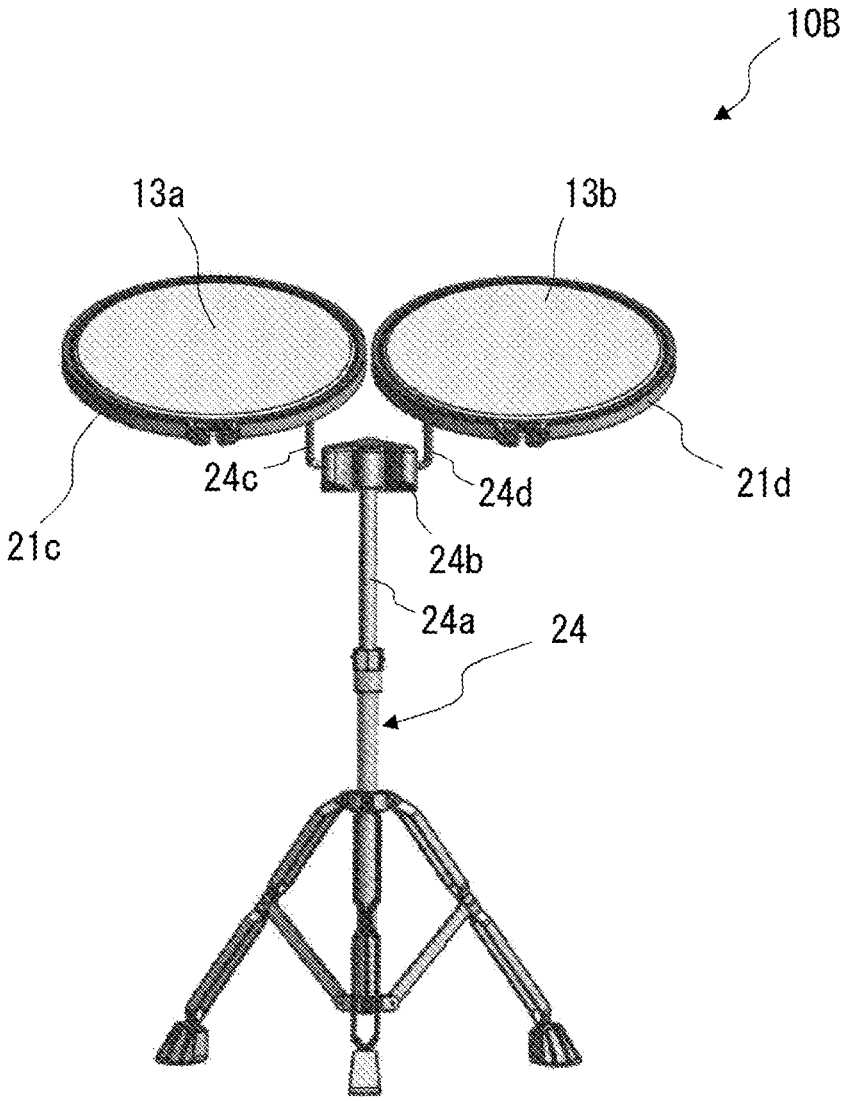
FIG. 3 shows another example of an electronic percussion instrument.
Figure 4:
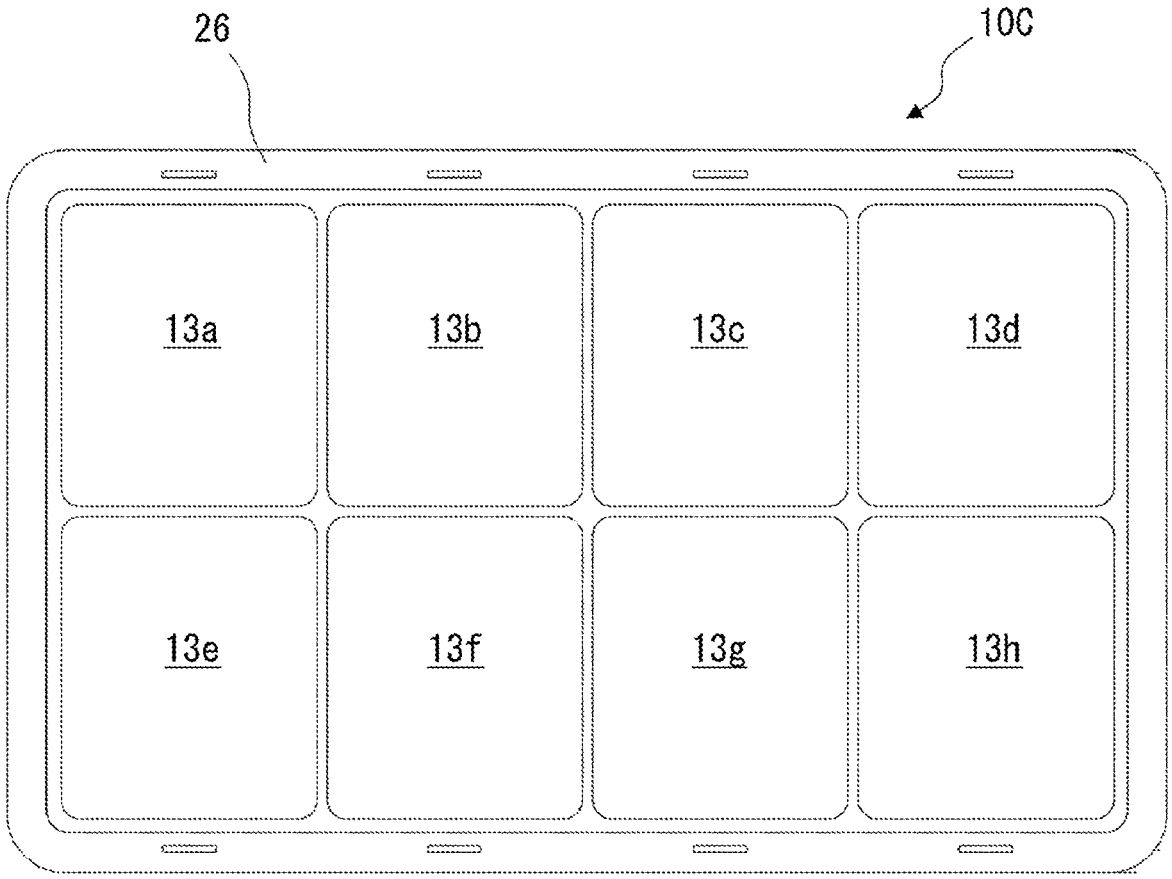
FIG. 4 shows another example of an electronic percussion instrument.

For example, the electronic musical instrument 10 may be an electronic percussion instrument 10A shown in FIG. 2, may be an electronic percussion instrument 10B shown in FIG. 3, or may be an electronic percussion instrument 10C shown in FIG. 4. The electronic percussion instrument 10A shown in FIG. 2 will also be referred to as "a double-headed drum" and has two percussive surfaces 13*a* and 13*b* directed in directions opposite to each other. The percussive surfaces 13*a* and 13*b* vibrate when a stroke is applied thereto using a stick, a drumstick, a hand, or the like. Each of the percussive surfaces 13*a* and 13*b* is formed to have a circular shape and is attached to (stretched across) each of ring-shaped frames 21*a* and 21*b*. The frame 21*a* and the frame 21*b* are joined to each other with eight joint rods 22 therebetween. The frames 21*a* and 21*b* and the joint rods 22 are examples of "a joint part".

In the electronic percussion instrument 10A, when one percussive surface of the percussive surfaces 13*a* and 13*b* vibrates, vibration thereof is transferred to the other percussive surface of the percussive surfaces 13*a* and 13*b* via the joint parts (frames and joint rods) and causes the other percussive surface to vibrate (excited vibration).

A controller 23 is disposed (fixed) inside a space between the percussive surface 13*a* and the percussive surface 13*b* surrounded by the joint rods 22. The controller 23 includes a casing in which a button group serving as the input device 18 and a display serving as the output device 19 are provided on a front surface thereof, and constituent elements (of the constituent elements shown in FIG. 1) other than the plurality of playing operation elements are accommodated inside the casing.

The electronic percussion instrument 10B shown in FIG. 3 has two percussive surfaces 13*a* and 13*b* which are disposed side by side on a tripod stand 24. The percussive surfaces 13*a* and 13*b* have a circular shape having the same size. The percussive surface 13*a* is provided (stretched across) within a ring-shaped frame 21*c*, and the percussive surface 13*b* is provided (stretched across) within a ring-shaped frame 21*d*.

The frame 21*c* and the frame 21*d* are respectively supported by rods 24*c* and 24*d* which extend individually from an upper end part 24*b* of a strut 24*a* of the tripod stand 24. The frame 21*c*, the rod 24*c*, the upper end part 24*b*, the rod 24*d*, and the frame 21*d* are examples of a joint part joining the percussive surface 13*a* and the percussive surface 13*b* to each other.

In the electronic percussion instrument 10B as well, when one percussive surface of the percussive surfaces 13*a* and 13*b* vibrates, vibration thereof is transferred to the other percussive surface of the percussive surfaces 13*a* and 13*b* via the joint parts and causes the other percussive surface to vibrate (excited vibration).

In the example shown in FIG. 3, percussive surfaces 13*a* and 13*b* are disposed in a bilaterally symmetrical manner with respect to a strut 24*a* of the tripod stand 24 and are disposed on the same plane. However, the heights of the percussive surfaces 13*a* and 13*b* and angular positions thereof toward a player (user) may differ from each other.

The electronic percussion instrument 10C shown in FIG. 4 is referred to as a multi-percussive surface pad. The electronic percussion instrument 10C has eight pads 13*a* to 13*h* constituting a plurality of percussive surfaces on the upper surface of a base (casing). In this manner, the electronic percussion instruments 10A, 10B, and 10C according to the embodiment have a plurality (an arbitrary number of 2 or larger) of percussive surfaces. When each of the pads 13*a* to 13*h* is struck, vibration thereof caused by a stroke is transferred to pads other than the struck pad via a casing 26 and causes the pads other than the struck pad to vibrate. The casing 26 acts as a joint part.

In the electronic percussion instruments 10A and 10B, when the percussive surface 13*a* (13*b*) is struck, in a case in which the percussive surface 13*b* (13*a*) vibrates due to excited vibration, the percussive surface 13*a* (13*b*) corresponds to "a first percussive surface (playing operation element)" and the percussive surface 13*b* (13*a*) corresponds to "a second percussive surface (playing operation element)". In this manner, in two percussive surfaces, a percussive surface which becomes a target for determining whether the vibration is self-induced vibration or excited vibration becomes "the second percussive surface (playing operation element)" and the other percussive surface causing excited vibration becomes "the first percussive surface (playing operation element)". Regarding the percussive surfaces 13*a* and 13*b* of the electronic percussion instrument 10C as well, the foregoing definition for the first and second percussive surfaces is valid. Moreover, in the electronic percussion instrument 10C, regarding two pads adjacent to each other in at least one of a vertical direction, a lateral direction, and an oblique direction, crosstalk cancellation having one as the second percussive surface (playing operation element) and the other as the first percussive surface (playing operation element) is executed.

Figure 5A:
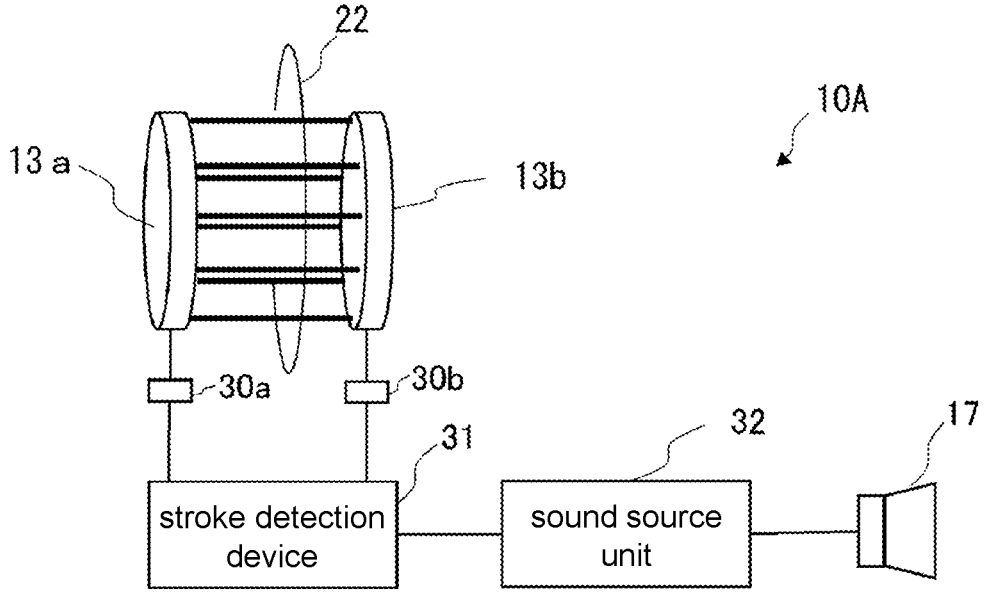
FIG. 5A schematically shows an electronic percussion instrument 10A, and FIG. 5B schematically shows an electronic percussion instrument 10B.
Figure 5B:
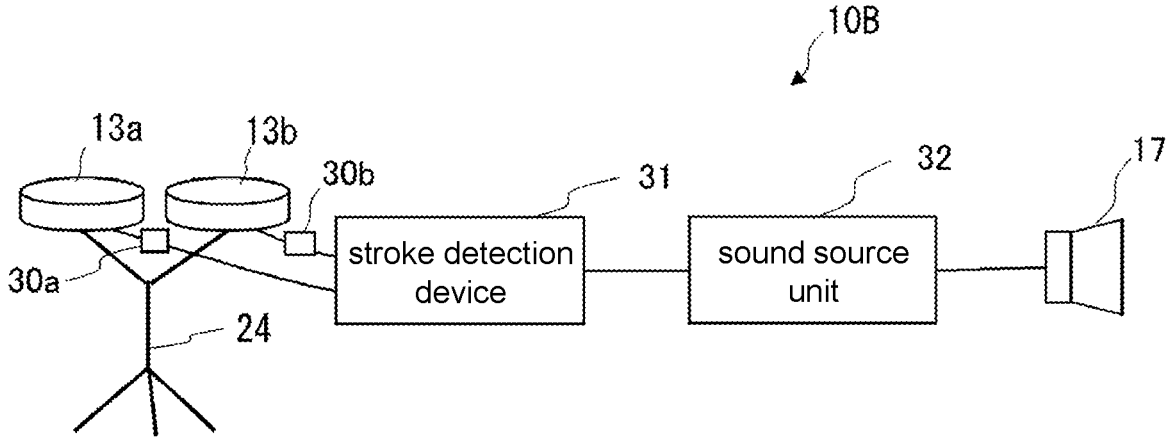

FIG. 5A schematically shows the electronic percussion instrument 10A, and FIG. 5B schematically shows the electronic percussion instrument 10B. The percussive surface 13*a* vibrates due to a stroke on the percussive surface 13*a*. This vibration is converted into an electrical analog signal by a vibration sensor (vibration detection element) 30*a*. On the other hand, the percussive surface 13*b* vibrates due to a stroke on the percussive surface 13*b*. This vibration is converted into an electrical analog signal by a vibration sensor (vibration detection element) 30*b*.

Vibration caused by a stroke on the percussive surface 13*a* is transferred to the percussive surface 13*b* via the joint parts and causes the percussive surface 13*b* to vibrate (excited vibration). An electrical signal output by the vibration sensor 30*b* includes not only the component of self-induced vibration on the percussive surface 13*b* but also the component of excited vibration. Similarly, an electrical signal output by the vibration sensor 30*a* includes not only the component of self-induced vibration on the percussive surface 13*a* but also the component of excited vibration.

When the CPU 11 executes the program stored in the storage device 12, the electronic instrument 10 operates as an apparatus including a stroke detection device 31 and a sound source unit 32. The stroke detection device 31 is formed to have the CPU 11 and the storage device 12. The sound source unit 32 is formed to have the sound source 14, the DAC 15, and the amplifier 16.

The stroke detection device 31 generates musical sound data (stroke information) corresponding to strokes on the percussive surfaces 13*a* and 13*b*, and the sound source unit 32 performs sound generation of musical sound on the basis of the stroke information. Musical sound is emitted as sound through the connected speaker 17.

Figure 6:
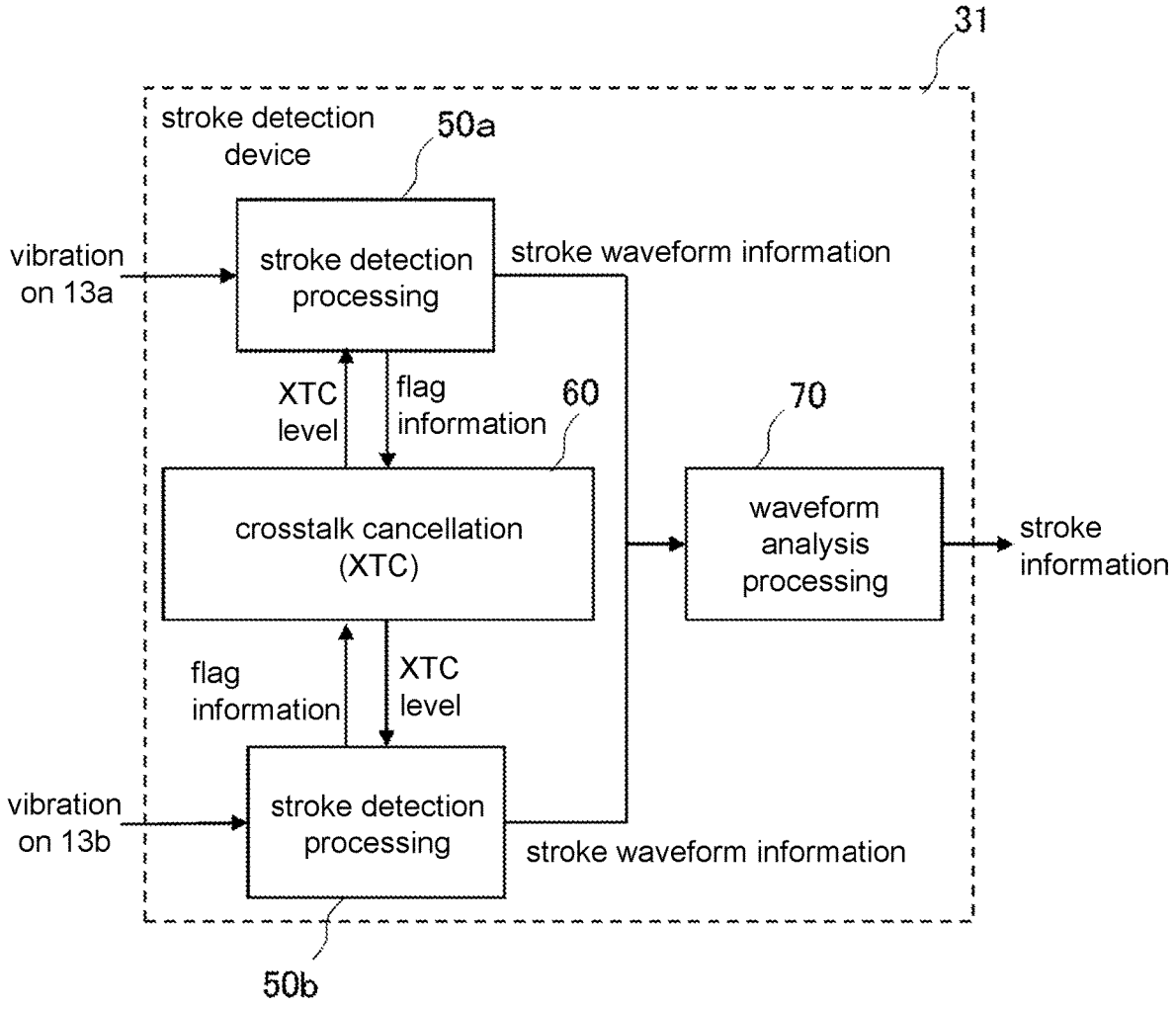
FIG. 6 shows processing performed by a stroke detection device.

FIG. 6 shows processing performed by the stroke detection device 31. The stroke detection device 31 performs stroke detection processing 50*a* for a vibration waveform of the percussive surface 13*a* and stroke detection processing 50*b* for a vibration waveform of the percussive surface 13*b*. Each of the stroke detection processing 50*a* and the stroke detection processing 50*b* is executed through interruption processing of the CPU 11 using a cycle time of 0.1 ms. The cycle time of 0.1 ms is an exemplification, and the cycle time may be longer or shorter than this. Each of the stroke detection processing 50*a* and the stroke detection processing 50*b* is performed using an XTC level at a corresponding time point t calculated through crosstalk cancellation (XTC) processing 60. As the stroke waveform information, the stroke detection processing 50*a* and the stroke detection processing 50*b* output information of vibration from which information of vibration determined as excited vibration from a waveform indicating vibration on each of the percussive surfaces 13*a* and 13*b* is excluded.

A waveform analysis processing 70 is executed on demand every time the stroke waveform information is generated. In the waveform analysis processing 70, a stroke waveform indicated based on the stroke waveform information is analyzed, and stroke information including one or more parameters related to a stroke, such as a strength and a polarity of a stroke, is generated. The stroke information is supplied to the sound source unit 32.

Figure 7:
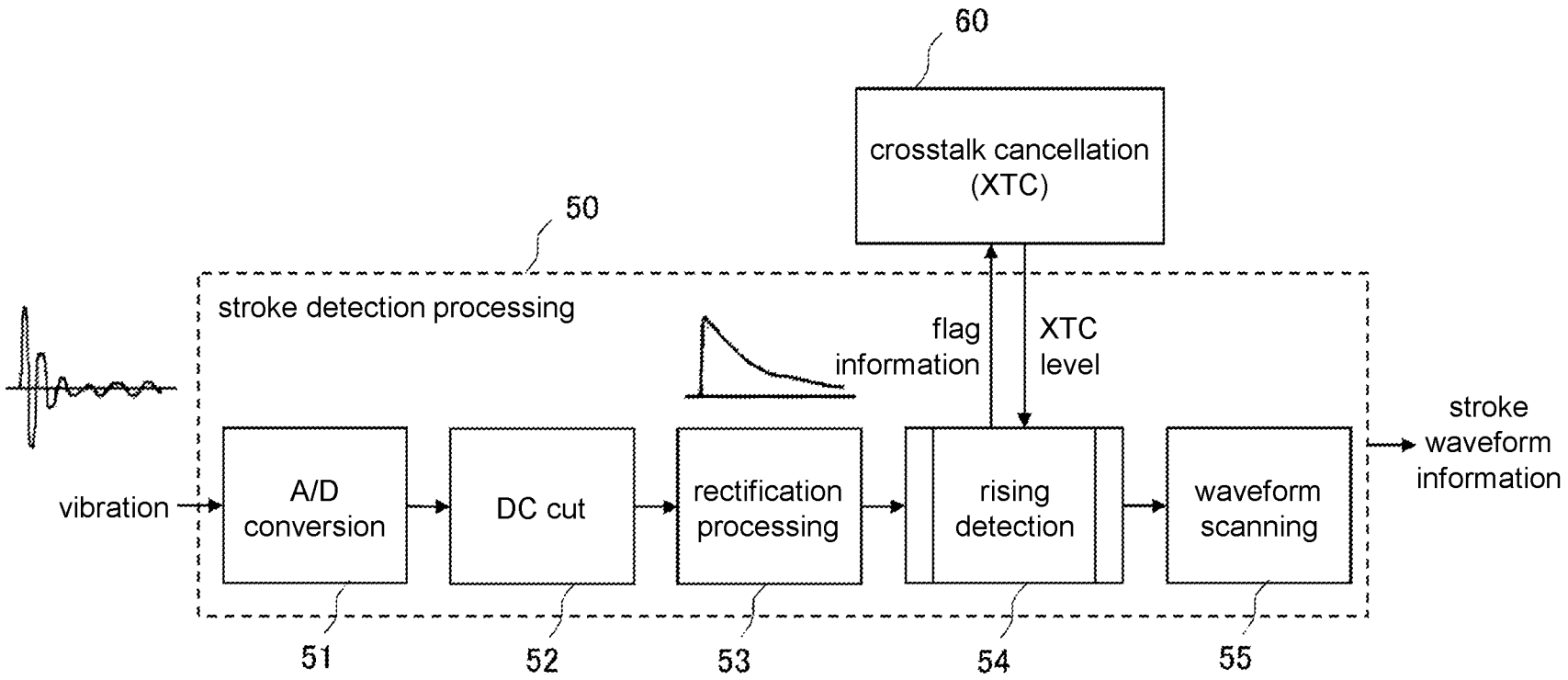
FIG. 7 is a block diagram showing details of stroke detection processing.

FIG. 7 is a block diagram showing details of the stroke detection processing 50*a* (50*b*). An analog signal indicating vibration of the percussive surface 13*a* (13*b*) is subjected to analog-digital conversion (A/D conversion 51). Subsequently, a DC component is removed from a digital signal (DC cut 52), and full-wave rectification processing is performed through rectification processing 53.

Regarding a waveform after the rectification processing 53, rising detection 54 for detecting rising of vibration (stroke) is executed. In the rising detection 54, when there is an input of a level exceeding a predetermined level (comparison target level: threshold) regarding a waveform after rectification, this input is detected as rising.

When rising is detected, an XTC flag (a flag for validity of XTC (calculation of an XTC level)) is set to be valid (turned on). While the XTC flag is valid, in the rising detection 54 cyclically executed regarding a percussive surface other than the percussive surface on which this XTC flag is set to be valid, the XTC level at the corresponding time point t calculated through the XTC processing 60 is supplied for the rising detection 54. For example, when the XTC flag is turned on in the rising detection 54 related to the percussive surface 13*a*, while the XTC flag is turned on, an XTC level (L(t)) generated based on the vibration waveform of the percussive surface 13*a* is supplied for the rising detection 54 of the percussive surface 13*b*.

The XTC level is used for determining whether an input level has exceeded a predetermined level set in consideration of the XTC level. When the input level has not exceeded the predetermined level, a waveform related to this input level is regarded as vibration caused by crosstalk, and scanning (waveform scanning 55) of this waveform does not start. Therefore, the stroke waveform information obtained as an output of the stroke detection processing 50 does not include information of a waveform which has been derived from crosstalk (generated on the basis of excited vibration) and has not been scanned.

When a predetermined time elapses after rising is detected, the XTC flag is set to be invalid (turned off). The waveform scanning 55 is processing in which an input level that is detected during a certain period (for example, from when the XTC flag becomes valid until it becomes invalid) after rising is detected and determined as self-induced vibration on a percussive surface is stored in an internal memory (for example, the storage device 12).

Figure 8:
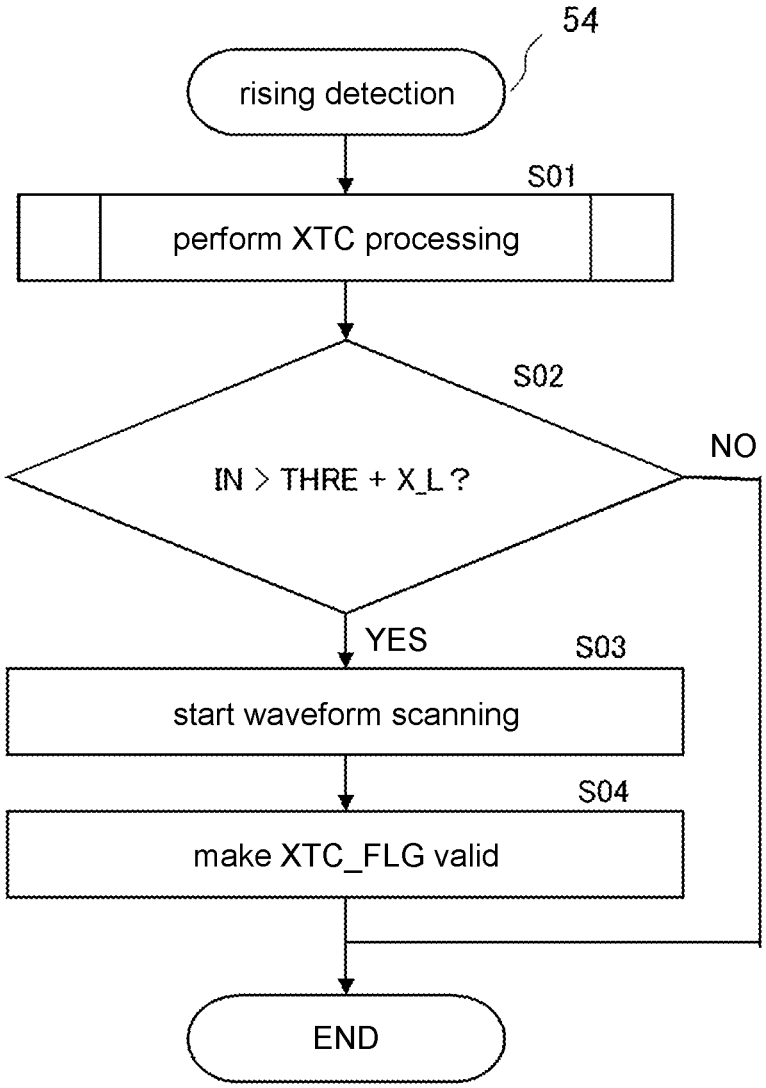
FIG. 8 is a flowchart showing an example of rising detection processing in the stroke detection device.

FIG. 8 is a flowchart showing an example of processing of the rising detection 54 in the stroke detection processing 50. A main constituent of the processing shown in FIG. 8 is the CPU 11 which operates as the stroke detection device 31. Terms and definitions used in the example of processing are as follows.

XTC: abbreviation of "crosstalk cancellation"

XTC_FLG: flag (XTC flag) used in the XTC processing (the flag is set to be invalid in an initial state)

IN: level of a waveform input to the rising detection 54

X_L: XTC level (the XTC level is used as a cancellation value for preventing crosstalk)

THRE: threshold used in rising detection

X_R: XTC rate (the XTC rate is a parameter which can be changed by a user and is used for changing a degree of effect of XTC (0<=X_R<=1))

X_C: internal coefficient used in calculation of an XTC level (a fixed value in this embodiment (0<=X_C<1))

T_E: ending time point of the XTC processing

T_P: time point at which the level L(t) indicated by an XTC envelope becomes the largest (reaches the peak) (T_P<T_E)

T_S: ending time point of waveform scanning (the largest amplitude value is recorded) (T_S<T_P)

The following are variables used when the XTC flag is valid.

T: counter (time) (the initial value oft is 0, and the counter is incremented (+1) every time the XTC processing is performed when any XTC flag is valid)

MAX(t): largest vibration value at the time point t

L(t): calculated value (reference value) of an XTC level at the time point t

In Step S01 shown in FIG. 8, the CPU 11 executes a subroutine of the XTC processing. The CPU 11 acquires the XTC level X_L at the corresponding time point t through the XTC processing. However, the XTC level is 0 while the XTC flag for the other (another) percussive surface is not valid (not turned on).

In Step S02, the CPU 11 determines whether or not the input level IN of a vibration waveform is larger than a value (predetermined value THRE+X_L) indicating a comparison target level set by adding the XTC level to the threshold THRE. As described above, since the XTC level is 0 when the XTC flag for the other (another) percussive surface is not valid, it is determined whether the input level IN is larger than the threshold THRE. In this manner, the XTC level is an example of a reference value for determining whether vibration on a percussive surface is self-induced vibration or excited vibration.

Here, when it is determined that the input level IN is larger than the value (THRE+X_L) (YES in Step S02), the processing proceeds to Step S03. If not (NO in Step S02), the processing shown in FIG. 8 ends.

In Step S03, the CPU 11 starts scanning of a waveform related to a level exceeding the threshold THRE (predetermined value THRE+X_L). In Step S04, the CPU 11 makes the XTC flag related to crosstalk cancellation for the percussive surface of itself valid and ends the processing.

Figure 9:
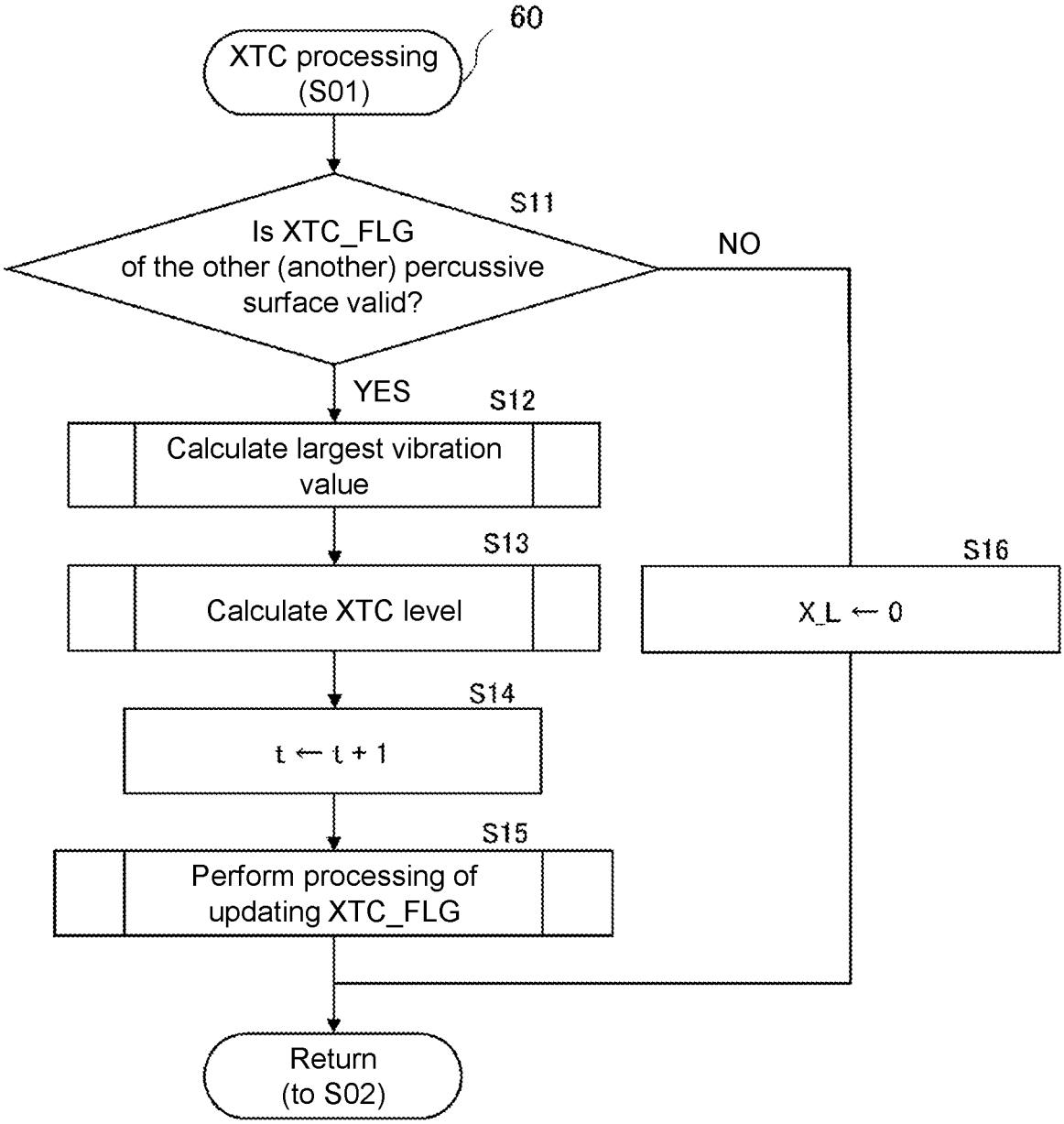
FIG. 9 is a flowchart showing an example of XTC processing.

FIG. 9 is a flowchart showing an example of the XTC processing 60. In Step S11, the CPU 11 determines whether or not the XTC flag for the other (another) percussive surface (the percussive surface 13*b* with respect to the percussive surface 13*a*, or the opposite thereof) is valid. When it is determined that the XTC flag is valid (YES in Step S11), the processing proceeds to Step S12. When it is determined that the XTC flag is invalid (NO in Step S11), the XTC level is set to 0 (Step S16), and the processing returns to Step S02 (FIG. 8).

Figure 10:
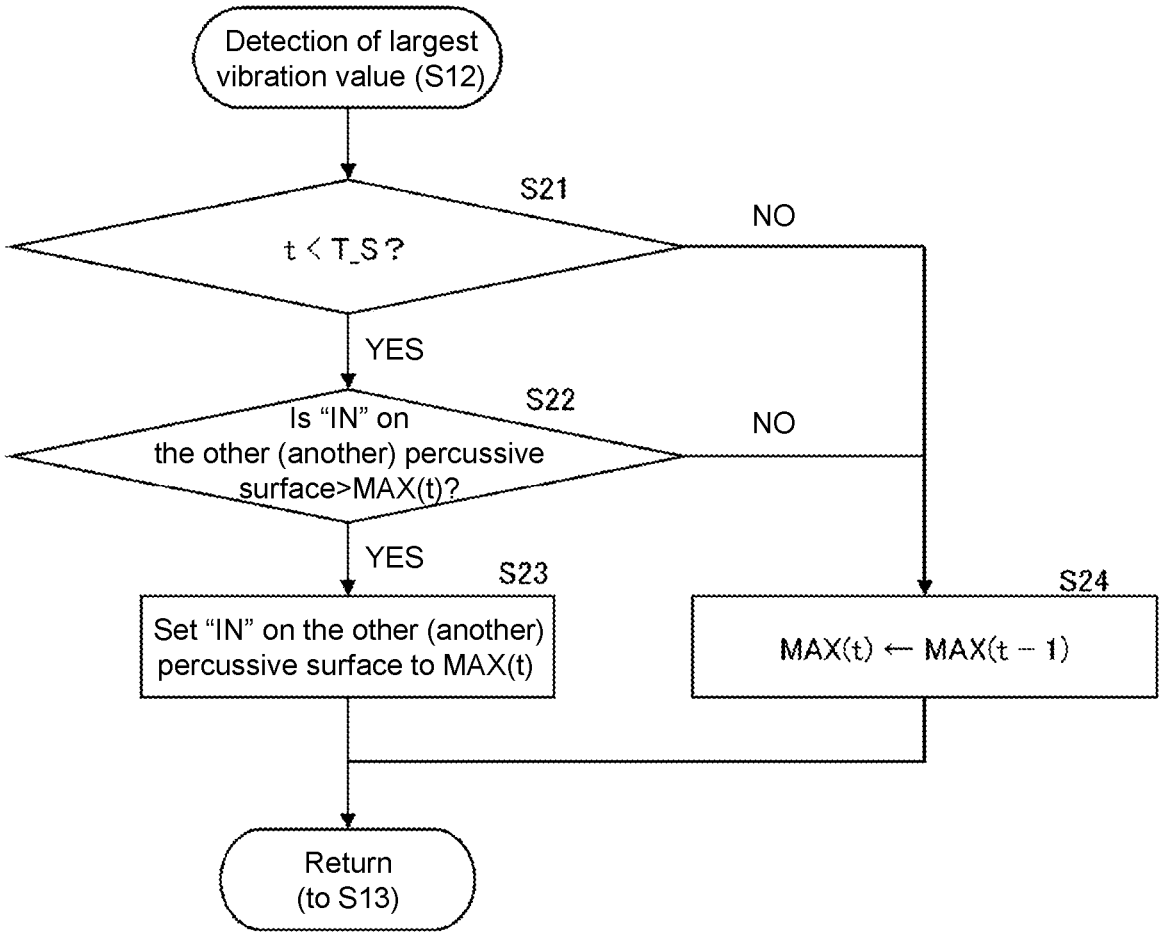
FIG. 10 is a flowchart showing an example of largest vibration value calculation processing.

In Step S12, the CPU 11 performs largest vibration value calculation processing. FIG. 10 is a flowchart showing an example of largest vibration value calculation processing. In FIG. 10, in Step S21, the CPU 11 determines whether or not the current time point t precedes the time point T_S (ending time point of waveform scanning for recording the largest vibration value). When it is determined that the current time point t has not reached the time point T_S (YES in Step S21), the processing proceeds to Step S22. If not (NO in Step S21), the processing proceeds to Step S24.

In Step S22, the CPU 11 determines whether the input level IN on the other (another) percussive surface having a valid XTC flag is larger than MAX(t) indicating the largest vibration value at the time point t. When it is determined that the level IN is larger than MAX(t) (YES in Step S22), the processing proceeds to Step S23. If not (NO in Step S22), the processing proceeds to Step S24.

In Step S23, the CPU 11 sets the value of IN to the value of MAX(t). Thereafter, the processing proceeds to Step S13 (FIG. 9). When the processing proceeds to Step S24, the CPU 11 sets a largest vibration value MAX(t−1) at a time point (t−1) one before the time point t to MAX(t), and the processing proceeds to Step S13.

Figure 11:
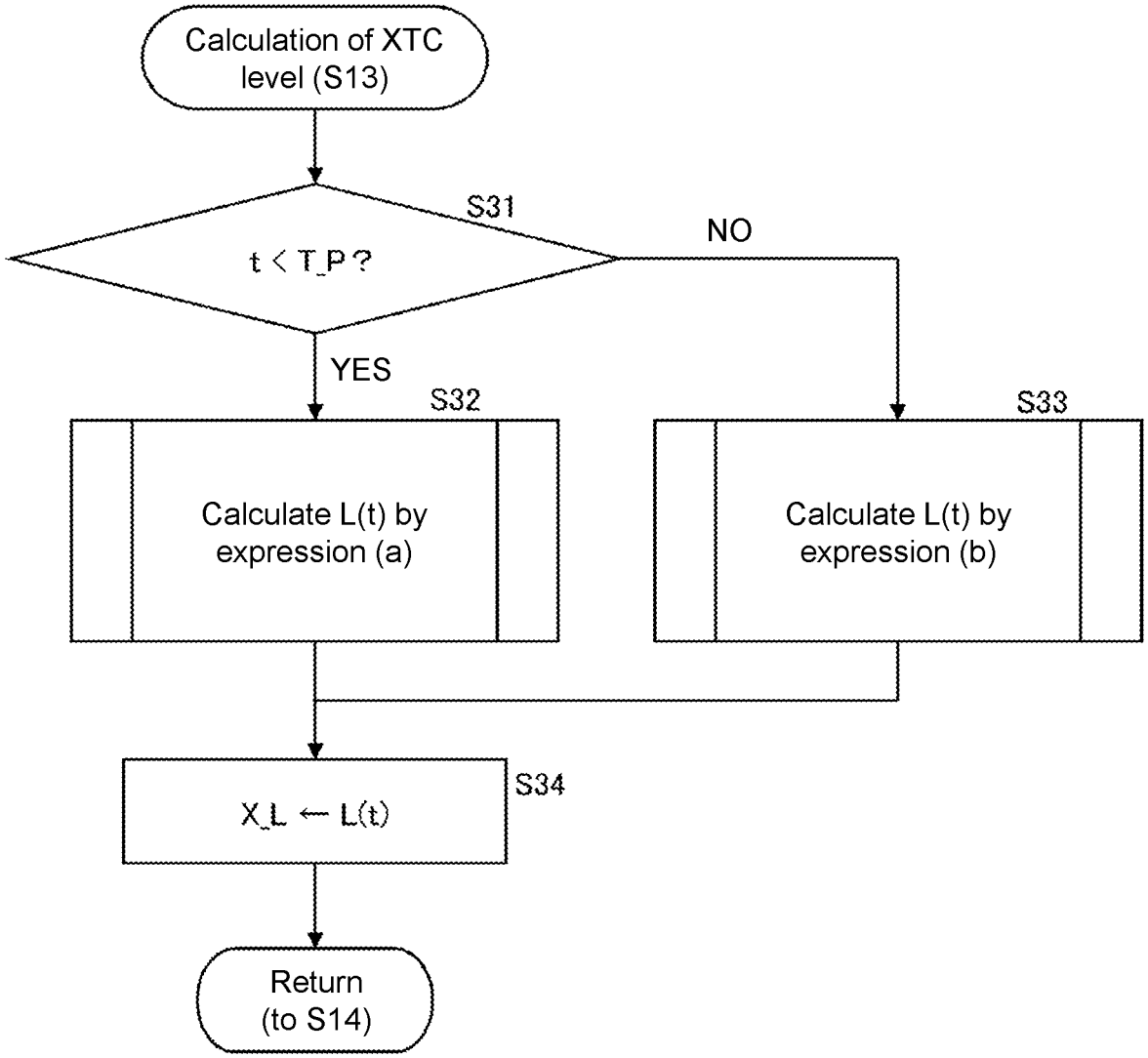
FIG. 11 is a flowchart showing an example of XTC level calculation processing.

In Step S13, the CPU 11 performs XTC level calculation processing. FIG. 11 is a flowchart showing an example of XTC level calculation processing. In the XTC level calculation processing, the XTC level supplied for the rising detection 54 with respect to the percussive surface 13*b* is calculated using the vibration waveform on the other (another) percussive surface 13*a* in which rising has been detected. That is, when rising on the percussive surface 13*a* of the percussive surfaces 13*a* and 13*b* is detected first, an XTC envelope generated using the vibration waveform of the percussive surface 13*a* is used for the stroke detection processing 50 on the percussive surface 13*b*.

In Step S31, the CPU 11 determines whether or not the current time point t precedes the time point T_P (time point at which the Level L(t) of the XTC envelope becomes the largest). When it is determined that the current time point t precedes the time point T_P (YES in Step S31), the processing proceeds to Step S32. When it is determined that it is not so (NO in Step S31), the processing proceeds to Step S33.

In Step S32, the CPU 11 calculates L(t) using the following Expression (a).

$$L(t)=\mathrm{MAX}(t)\times X_R\times(X_C+t\times(1-X_C)/T_P) \quad \text{(a)}$$

In Step S33, the CPU 11 calculates L(t) using the following Expression (b).

$$L(t)=\mathrm{MAX}(t)\times X_R/(T_E-T_P)\times(T_E-t) \quad \text{(b)}$$

In Step S34, the CPU 11 sets the value of L(t) obtained in Step S32 or S33 to the XTC level X_L, and the processing returns to Step S14 (FIG. 9).

Figure 12:
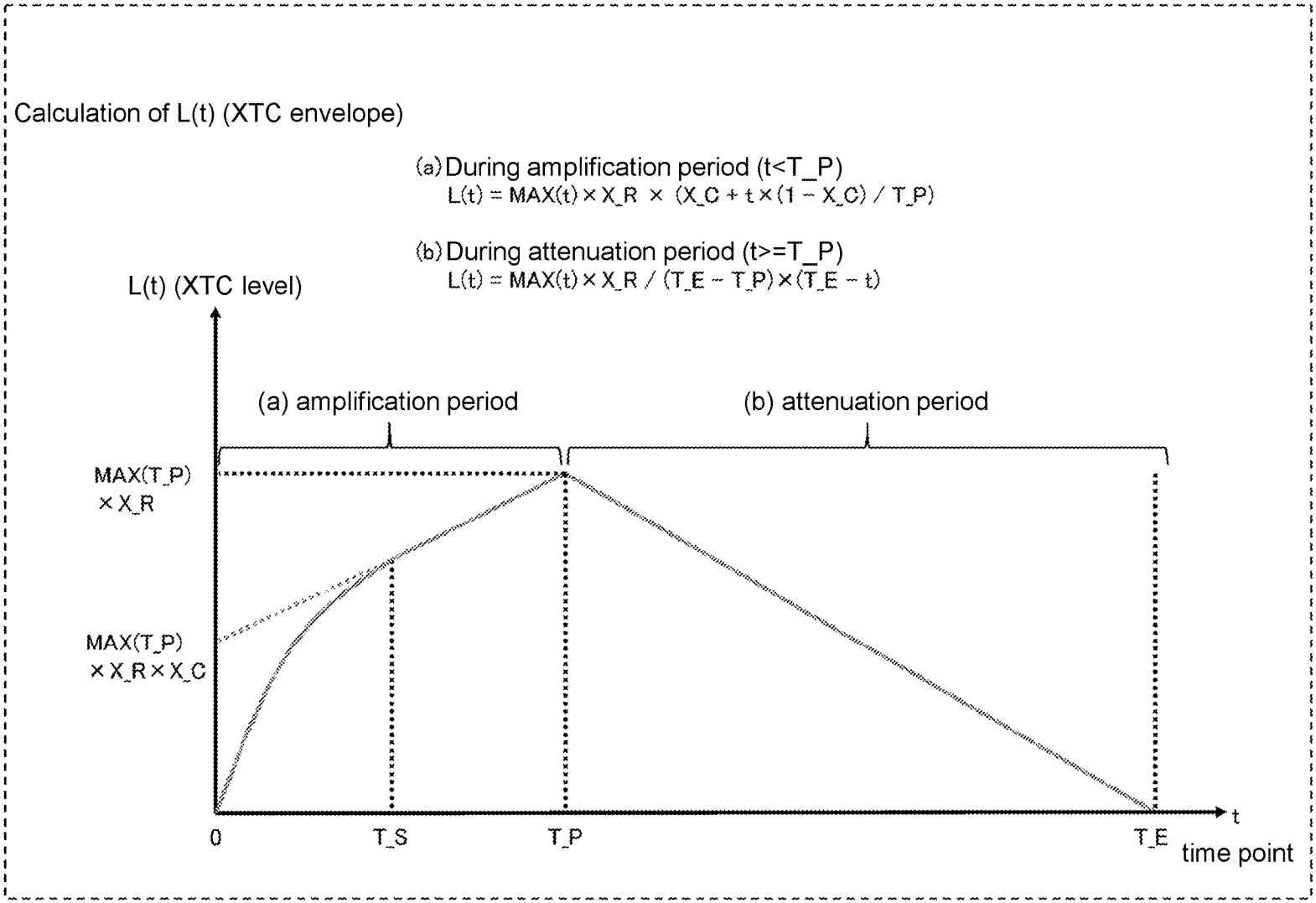
FIG. 12 is a view illustrating a method of calculating an XTC level (method of generating an XTC envelope).

FIG. 12 is a view illustrating a method of calculating L(t) (XTC envelope). The XTC envelope indicates a change in L(t) over time indicating an XTC level at each time point t and can be expressed as an envelope curve waveform shown in FIG. 12.

The time point T_P in FIG. 12 is a time point at which the XTC level L(t) becomes the largest (reaches the peak). The time point of t=0 indicates a time point at which the XTC flag is set to be valid. During a period from the time point 0 to the time point T_S, processing of calculating the largest vibration value MAX(t) (FIG. 10) is executed.

In this embodiment, the value of the XTC level L(t) at the time point T_P is defined as "MAX(T_P)×X_R". MAX (T_P) indicates the largest vibration value at the time point T_P. X_R (XTC rate) is a value indicating the degree of effect of crosstalk cancellation. As the XTC rate increases, vibration regarded as crosstalk (excluded from the stroke waveform information) increases.

The value of the XTC level L(t) becomes the largest at the time point T_P. During a period (first period) from the time point of t=0 (an example of a starting point) to the time point T_P (an example of a first time point) which is an amplification period, L(t) increases with the elapse of time. The value of L(t) at the time point of t=0 may be 0. Alternatively, the value of "MAX(T_P)×X_R×X_C" may be used as shown in FIG. 12.

X_C is an internal coefficient (predetermined coefficient) for linearly increasing L(t) toward the largest value "MAX (T_P)×X_R" of L(t) and has a value within a range of 0 to smaller than 1. When the time length of the first period is constant, as the value of X_C decreases, the gradient of increase becomes larger. In addition, during a period (second period) from the time point T_P to the ending point T_E (an example of a second time point) which is an attenuation period, L(t) decreases with the elapse of time.

Expression (a) for obtaining L(t) is a function for linearly increasing L(t) during the first period, and Expression (b) is a function for linearly decreasing L(t) during the second period. Expressions (a) and (b) are calculated using the parameters MAX(t), X_R, X_C, t, and T_P which have been described above. MAX(t) is obtained through calculation, and the value oft is obtained from an increment (clocking) of a counter.

Each of the parameters X_R, X_C, T_P, and T_S is a value set in advance through an experiment, a simulation, or the like and is stored in the storage device 12. However, these may be received by the CPU 11 through communication when the XTC rate is calculated or may be acquired from a storage device other than the storage device 12.

In Step S14 (FIG. 9), the value of the counter managing the time t is incremented and becomes a value constituted by adding 1 to the current value of t. In Step S15, processing of updating the XTC flag is executed.

Figure 13:
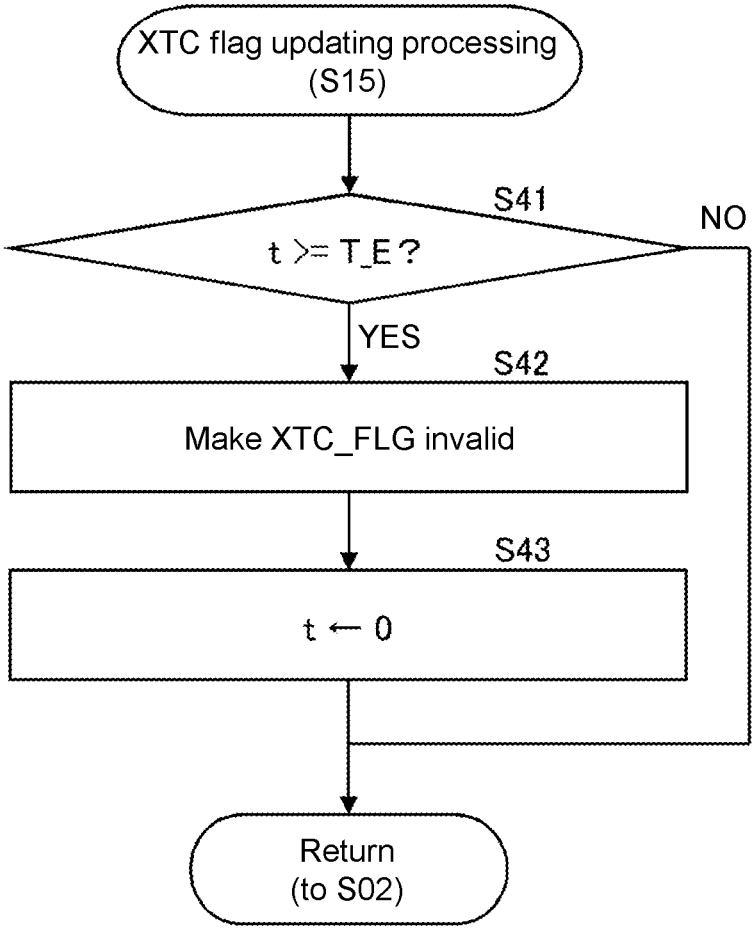
FIG. 13 is a flowchart showing an example of processing of updating an XTC flag.

FIG. 13 is a flowchart showing an example of processing of updating an XTC flag. In Step S41, the CPU 11 determines whether or not the current time point t has reached the ending point T_E. When it is determined that the time point t has reached the ending point T_E (YES in Step S41), the processing proceeds to Step S42. If not (NO in Step S41), the processing of updating the XTC flag ends, the XTC processing also ends, and the processing proceeds to Step S02. In Step S43, the current time point t is set to 0 (Step S43).

Figure 14A:
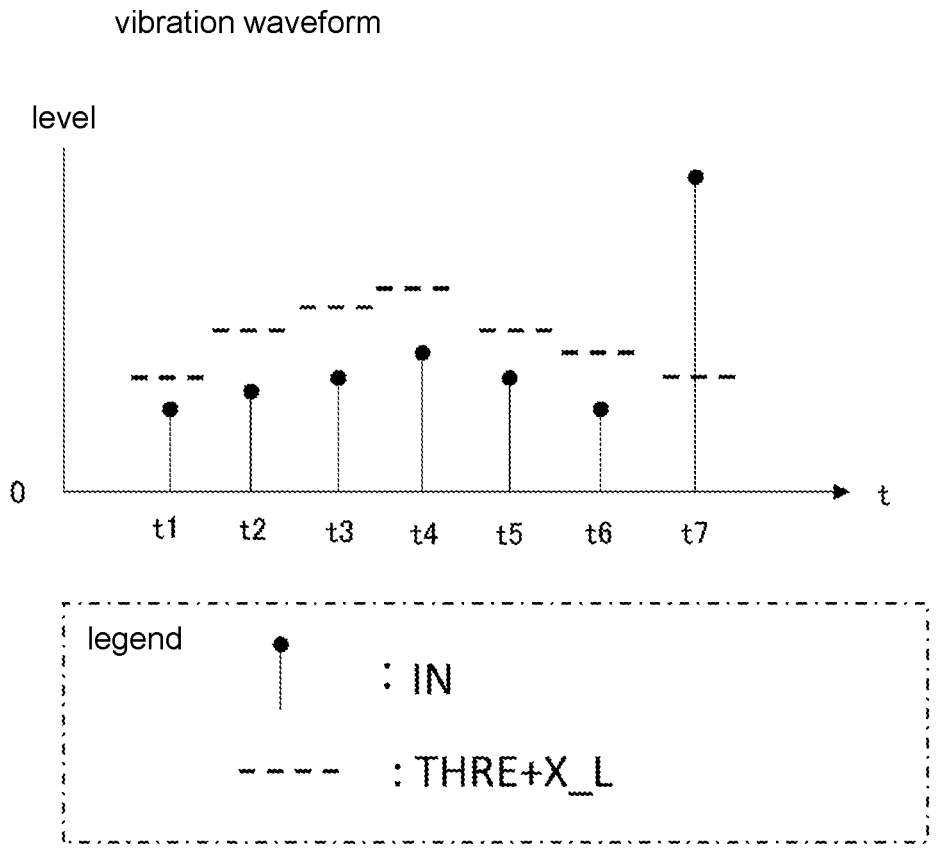
FIG. 14A is a view illustrating a vibration waveform.
Figure 14B:
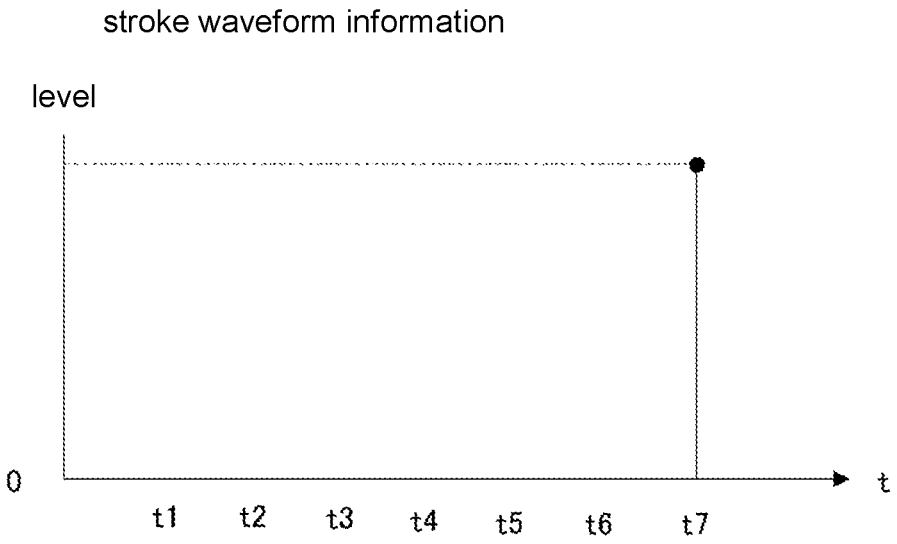
FIG. 14B is a view illustrating stroke waveform information.

FIG. 14A is a view illustrating XTC, and FIG. 14B is a view illustrating stroke waveform information obtained through XTC. In the graph of FIG. 14A, the perpendicular lines having an upper end with a black dot at time points (times) t1 to t7 indicate samples of vibration waveform signals, and the heights of the perpendicular lines indicate the heights (input levels IN) of the levels. The dotted line orthogonal to each of the perpendicular lines indicates a predetermined level for comparison with the input level IN.

At the times t1 to t7, all the XTC flags are valid (turned on), and the input level IN is compared to the predetermined level (0<X_L) set by adding the XTC level X_L to the threshold THRE. At the times t1 to t6, the input level IN falls below the predetermined level, and at the time t7, the input level IN surpasses the predetermined level.

The sample exceeding the predetermined level becomes a target of the waveform scanning 55, and the sample not exceeding the predetermined level is excluded from the target of the waveform scanning 55. In other words, the waveform scanning 55 is performed for the sample exceeding the predetermined level, and the waveform scanning 55 is not performed for the sample not exceeding the predetermined level. As a result, as shown in FIG. 14B, information indicating the level of the sample exceeding the predetermined level (sample at the time t7) is used as the stroke waveform information.

Here, if the samples at the times t1 to t6 are samples derived from crosstalk (on the basis of excited vibration), information related to these samples is not included in the stroke waveform information. This denotes that no crosstalk-derived component is included in the stroke information supplied to the sound source unit 32. Therefore, crosstalk-derived sound generation is not performed, and crosstalk is canceled. In this manner, the stroke detection device 31 performs processing of preventing information on the basis of excited vibration (crosstalk) on a certain percussive surface from being included in information indicating a stroke (operation) on a certain percussive surface (playing operation element) using the XTC level indicated by the XTC envelope.

Figure 15:
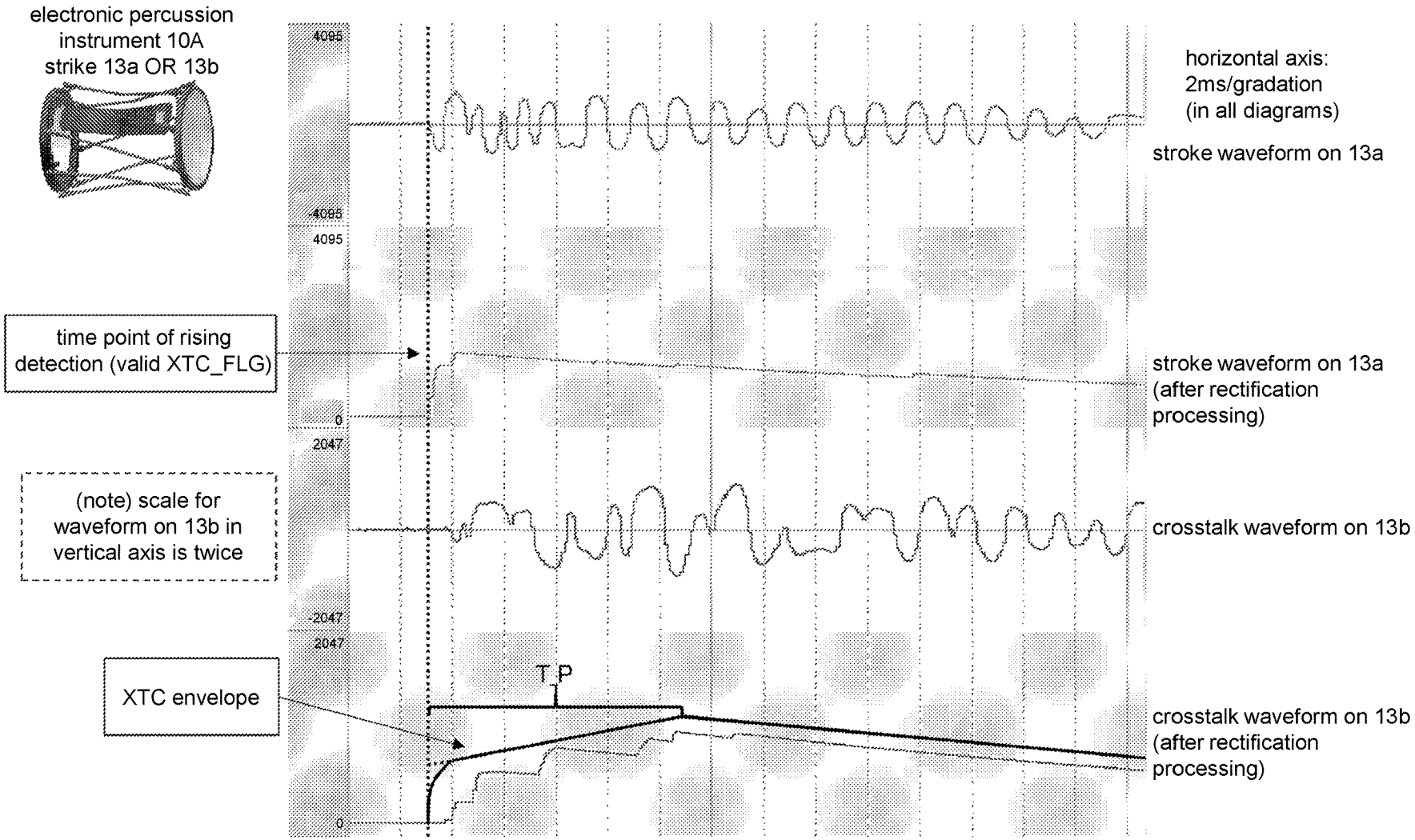
FIG. 15 shows signal waveforms in a case in which one (percussive surface 13*a*) of a percussive surface 13*a* and a percussive surface 13*b* of the electronic percussion instrument 10A is struck.

FIG. 15 shows signal waveforms in a case in which one (assuming that it is the percussive surface 13*a*) of the percussive surface 13*a* and the percussive surface 13*b* of the electronic percussion instrument 10A is struck. The uppermost stage indicates a waveform (self-induced vibration waveform of the percussive surface 13*a*) when the percussive surface 13*a* is struck. The second stage from above indicates a stroke waveform of the percussive surface 13*a* after rectification processing. The third stage from above indicates excited vibration (crosstalk) on the percussive surface 13*b* entailed by a stroke on the percussive surface 13*a*. The fourth stage from above (lowermost stage) indicates a crosstalk waveform of the percussive surface 13*b* after the rectification processing. Crosstalk of the percussive surface 13*b* is canceled using the XTC envelope generated using the self-induced vibration waveform of the percussive surface 13*a*.

Figure 16:
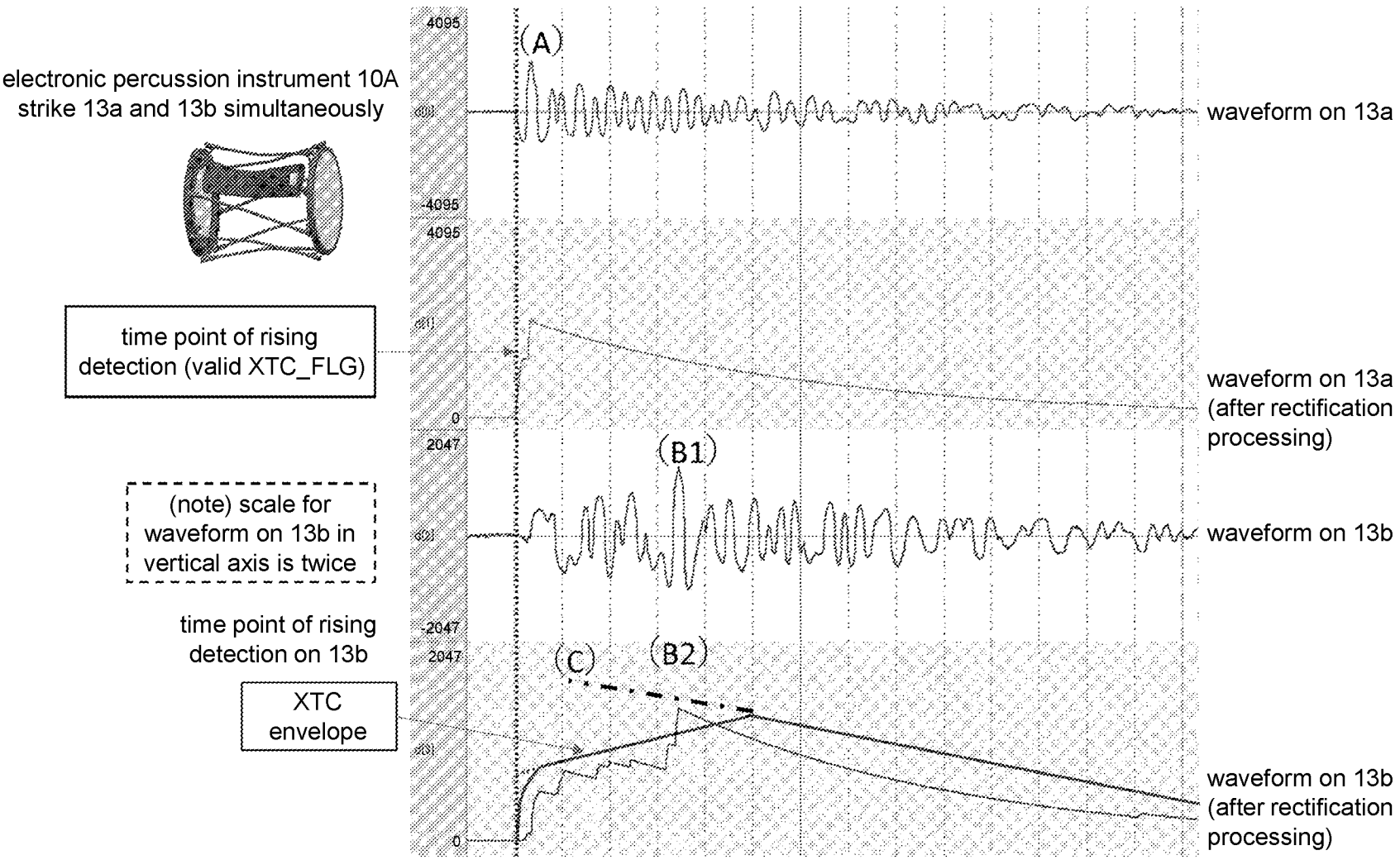
FIG. 16 shows signal waveforms in a case in which simultaneous striking is executed on both the percussive surface 13*a* and the percussive surface 13*b* of the electronic percussion instrument 10A.

FIG. 16 shows signal waveforms in a case in which simultaneous striking is executed on both the percussive surface 13*a* and the percussive surface 13*b* of the electronic percussion instrument 10A. The uppermost stage in FIG. 16 indicates a vibration waveform (including self-induced vibration on the percussive surface 13*a* and crosstalk entailed by a stroke on the percussive surface 13*b*) on the percussive surface 13*a*. The second stage from above indicates a vibration waveform of the percussive surface 13*a* after rectification processing. The third stage from above indicates a vibration waveform of the percussive surface 13*b* (including self-induced vibration on the percussive surface 13*b* and crosstalk entailed by a stroke on the percussive surface 13*a*). The fourth stage from above (lowermost stage) indicates a vibration waveform of the percussive surface 13*b* after the rectification processing. Crosstalk of the percussive surface 13*b* is canceled using the XTC envelope generated using the vibration waveform of the percussive surface 13*a*.

The peak (A) in FIG. 16 indicates a peak due to a stroke on the percussive surface 13*a*, and the peak (B1) indicates a peak due to a stroke on the percussive surface 13*b*. When rising of the peak (A) is detected regarding the percussive surface 13*a*, the XTC flag becomes valid regarding the percussive surface 13*b* so that the XTC level indicated by the XTC envelope generated based on the vibration waveform of the percussive surface 13*a* is used for the rising detection 54 of the percussive surface 13*b*, and it is determined whether or not to take it as a target of the waveform scanning 55 through comparison between the input level and the predetermined level (S02 in FIG. 8).

Since one gradation in the graph of FIG. 16 is 2 ms, even in a case of simultaneous striking, a deviation occurs between timings of both strokes when they are seen in minute time units. This peak (B1) is supposed to be a target of the waveform scanning 55. Here, as shown in the graph in the lowermost stage, in the XTC envelope generated using the vibration waveform of the percussive surface 13*a*, the level of the peak (B2) after rectification of the peak (B1) is higher than the XTC level indicated by the envelope. For this reason, it becomes a target of the waveform scanning 55 in the rising detection 54 and is included in the stroke waveform information of the percussive surface 13*b*.

In FIG. 16, the straight line (C) indicated by the one-dot dashed line shows a part of an XTC envelope on the basis of a technology disclosed in Japanese Patent Publication No. H7-69687 as a comparative example. The XTC envelope of the comparative example attenuates from the rising of vibration. For this reason, the peak (B1) falls below the envelope, and the peak (B1) is no longer scanned. That is, sound generation due to self-induced vibration on the percussive surface 13*b* is no longer performed. In the XTC envelope of the embodiment, such a problem can be avoided.

Figure 17:
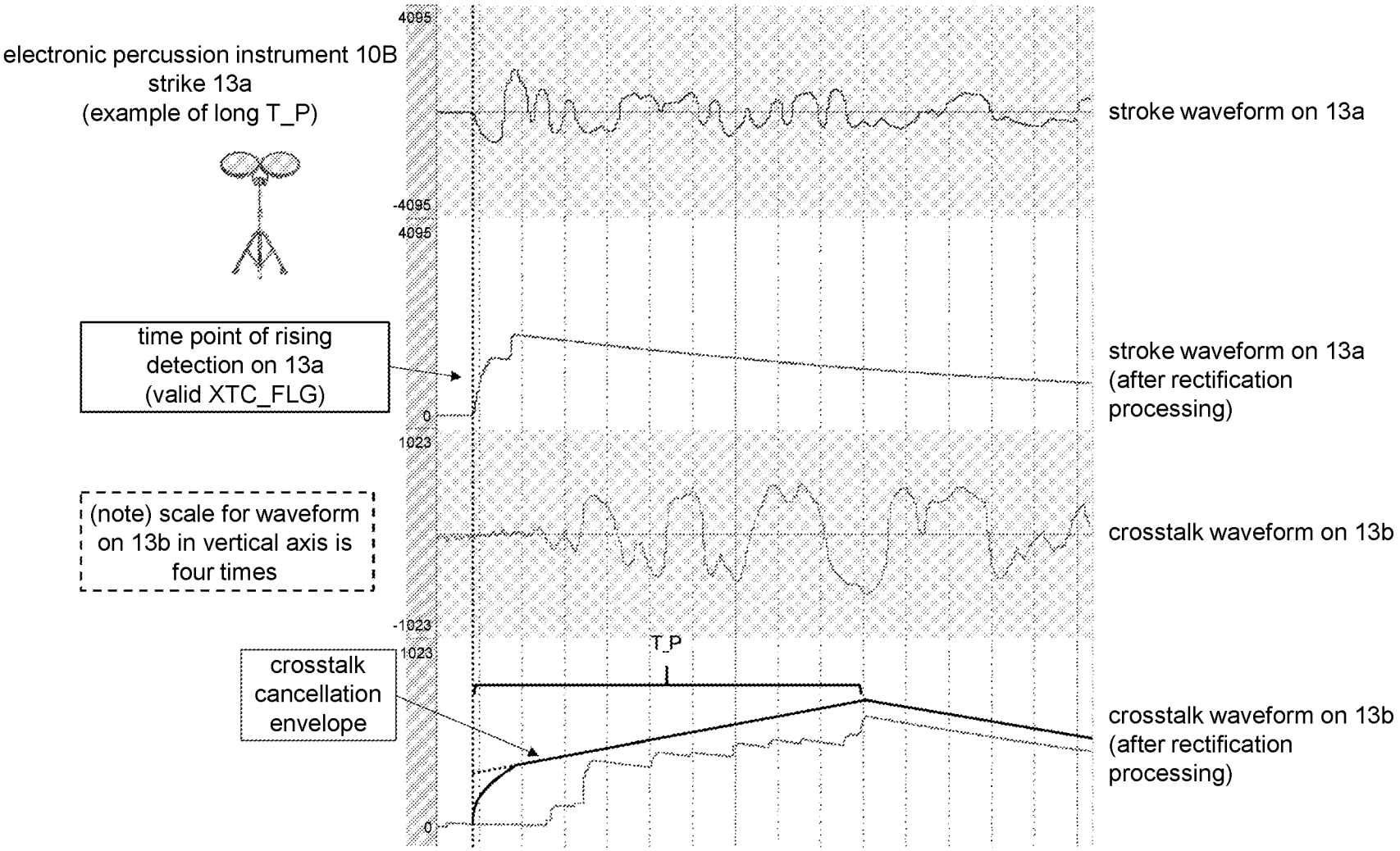
FIG. 17 shows signal waveforms in a case in which one (percussive surface 13*a*) of the percussive surface 13*a* and the percussive surface 13*b* of the electronic percussion instrument 10B is struck.

FIG. 17 shows signal waveforms in a case in which one (assuming that it is the percussive surface 13*a*) of the percussive surface 13*a* and the percussive surface 13*b* of the electronic percussion instrument 10B is struck. The uppermost stage indicates a waveform (self-induced vibration waveform of the percussive surface 13*a*) when the percussive surface 13*a* is struck. The second stage from above indicates a stroke waveform of the percussive surface 13*a* after rectification processing. The third stage from above indicates excited vibration (crosstalk) on the percussive surface 13*b* entailed by a stroke on the percussive surface 13*a*. The fourth stage from above (lowermost stage) indicates a crosstalk waveform of the percussive surface 13*b* after the rectification processing. Crosstalk of the percussive surface 13*b* is canceled using the XTC envelope generated using the self-induced vibration waveform of the percussive surface 13*a*.

Figure 18:
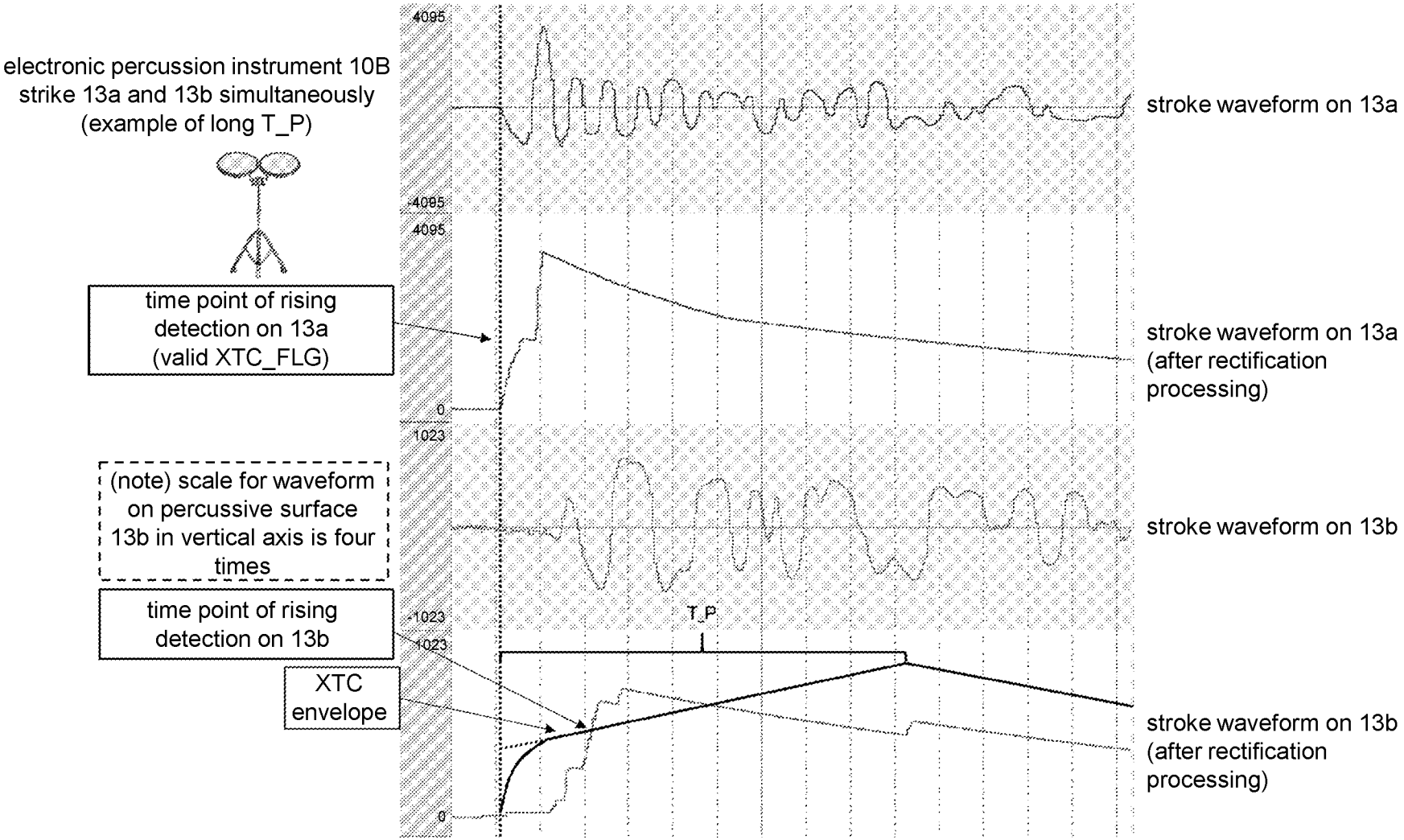
FIG. 18 shows signal waveforms in a case in which simultaneous striking is executed on both the percussive surface 13*a* and the percussive surface 13*b* of the electronic percussion instrument 10B.

FIG. 18 shows signal waveforms in a case in which simultaneous striking is executed on both the percussive surface 13*a* and the percussive surface 13*b* of the electronic percussion instrument 10B. The uppermost stage in FIG. 18 indicates a vibration waveform (including self-induced vibration on the percussive surface 13*a* and crosstalk entailed by a stroke on the percussive surface 13*b*) on the percussive surface 13*a*. The second stage from above indicates a vibration waveform of the percussive surface 13*a* after rectification processing. The third stage from above indicates a vibration waveform of the percussive surface 13*b* (including self-induced vibration on the percussive surface 13*b* and crosstalk entailed by a stroke on the percussive surface 13*a*). The fourth stage from above (lowermost stage) indicates a vibration waveform of the percussive surface 13*b* after the rectification processing. Crosstalk of the percussive surface 13*b* is canceled using the XTC envelope generated using the vibration waveform of the percussive surface 13*a*.

The electronic percussion instrument 10B has rigidities of the joint parts lower than the rigidities of the joint parts of the electronic percussion instrument 10A and has a transfer velocity of vibration slower than that on the electronic percussion instrument 10A. For this reason, the length of T_P is longer than that of the electronic percussion instrument 10A.

Figure 19:
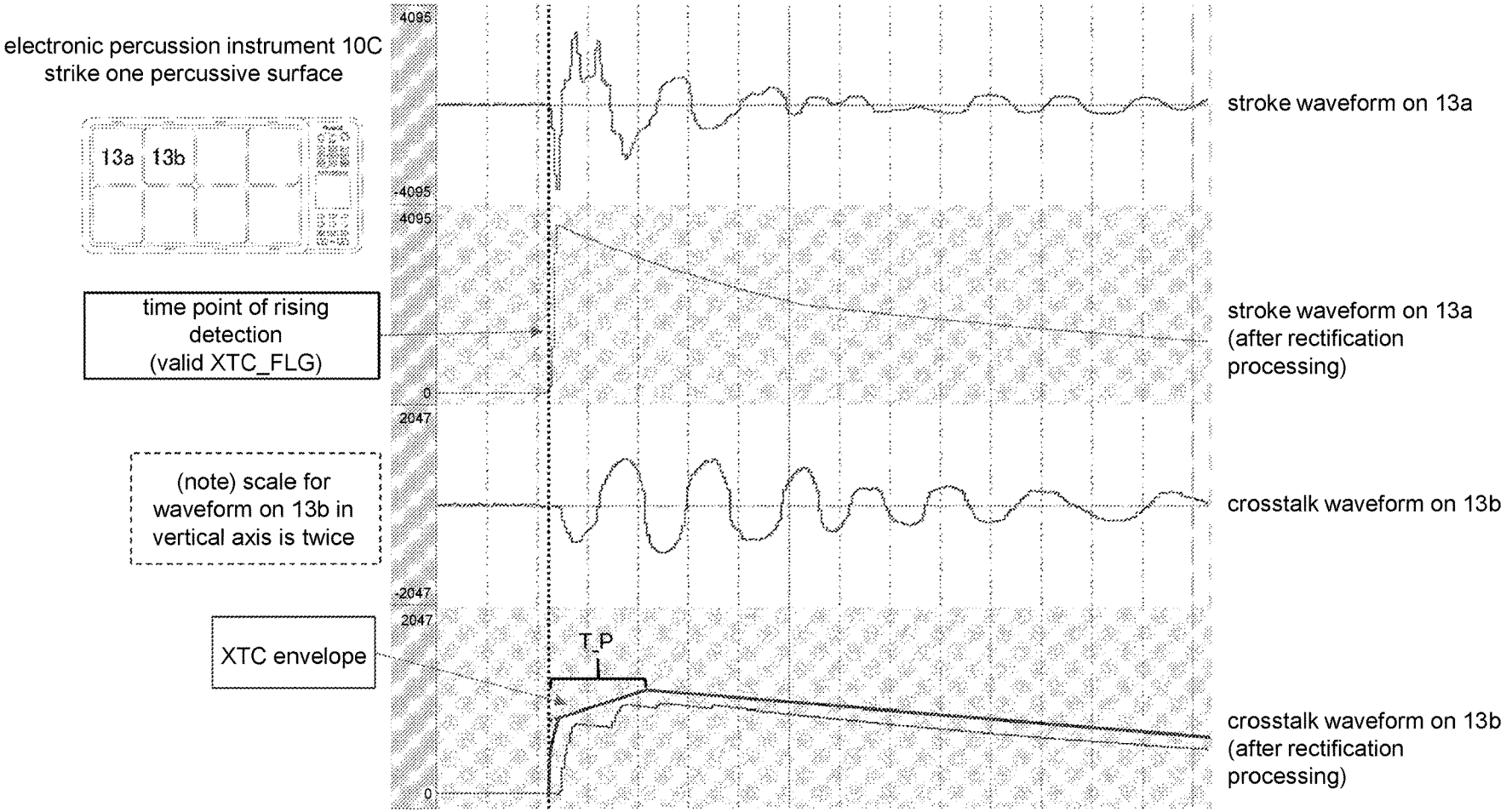
FIG. 19 shows signal waveforms on the percussive surface 13*a* and the percussive surface 13*b* adjacent to the percussive surface 13*a* in a case in which the percussive surface 13*a* of an electronic percussion instrument 10C is struck.

FIG. 19 shows signal waveforms on the percussive surface 13*a* and the percussive surface 13*b* adjacent to the percussive surface 13*a* in a case in which the percussive surface 13*a* of the electronic percussion instrument 10C is struck. The uppermost stage indicates a waveform (self-induced vibration waveform of the percussive surface 13*a*) when the percussive surface 13*a* is struck. The second stage from above indicates a stroke waveform of the percussive surface 13*a* after rectification processing. The third stage from above indicates excited vibration (crosstalk) on the percussive surface 13*b* entailed by a stroke on the percussive surface 13*a*. The fourth stage from above (lowermost stage) indicates a crosstalk waveform of the percussive surface 13*b* after the rectification processing. Crosstalk of the percussive surface 13*b* is canceled using the XTC envelope generated using the self-induced vibration waveform of the percussive surface 13*a*.

Since the pads of the electronic percussion instrument 10C are disposed on a hard resin casing, it is easier for vibration to be transferred therein than in the electronic percussion instruments 10A and 10B. For this reason, the time length of T_P is short.

According to the embodiment, crosstalk cancellation processing can be applied to an electronic percussion instrument such as an electronic percussion instrument 10A having two percussive surfaces 13*a* and 13*b* directed in directions opposite to each other. In addition, in the electronic percussion instruments 10A, 10B, and 10C according to the embodiment, crosstalk can be canceled appropriately. Moreover, in a case in which two percussive surfaces are simultaneously struck such as simultaneous striking, even if a deviation occurs between timings of strokes, it is possible to avoid the peak due to a stroke on a side behind time from being removed as crosstalk.

In the embodiment, an aspect of generating an envelope has been described. However, an envelope (a change in L(t) over time) may be stored in the storage device 12 in advance, and the XTC level L(t) corresponding to the time t may be read from the storage device 12 and supplied in the step of calculating an envelope. In this way, a load on the CPU 11 can be reduced, and the processing time can be shortened. The configurations shown in the embodiment can be suitably combined within a range not departing from the objectives.

It will be apparent to those skilled in the art that various modifications and variations can be made to the disclosed embodiment without departing from the scope or spirit of the disclosure. In view of the foregoing, it is intended that the disclosure covers modifications and variations provided that they fall within the scope of the following claims and their equivalents.

What is claimed is:

1. An electronic musical instrument comprising a first playing operation element and a second playing operation element, the electronic musical instrument comprising:

a control device that performs a process of generating an envelope indicating a change in a reference value over time based on a waveform that indicates vibration of the first playing operation element, wherein the reference value is for determining whether vibration of the second playing operation element is self-induced vibration or excited vibration entailed by the vibration of the first playing operation element, wherein when the vibration of the second playing operation element is determined by the reference value, the control device performs a process of preventing first information on a basis of the excited vibration of the second playing operation element from being included in second information that indicates the self-induced vibration of the second playing operation element through using the reference value indicated by the envelope.

2. The electronic musical instrument according to claim 1, wherein the envelope indicates an increase in the reference value during a first period from a starting time point to a first time point and indicates a decrease in the reference value during a second period from the first time point to an ending point.

3. The electronic musical instrument according to claim 2, at every predetermined time point, the control device compares a level of a waveform indicating vibration of the second playing operation element and a comparison target level set by adding the reference value at a corresponding time point indicated by the envelope to a threshold, and the control device scans a waveform exceeding the comparison target level and does not scan any waveform not exceeding the comparison target level.

4. The electronic musical instrument according to claim 2, wherein a value of the reference value at the starting time point is a value obtained by multiplying a largest vibration value at the first time point by a predetermined coefficient.

5. The electronic musical instrument according to claim 1, wherein the electronic musical instrument is an electronic percussion instrument, and wherein the first playing operation element and the second playing operation element are a first percussive surface and a second percussive surface, respectively.

6. The electronic musical instrument according to claim 5, wherein the second percussive surface is directed in a direction opposite to a direction of the first percussive surface.

7. The electronic musical instrument according to claim 6, wherein the first percussive surface is joined to the second percussive surface with a joint part therebetween.

8. An information processing device for an electronic musical instrument comprising a first playing operation element and a second playing operation element, the information processing device comprising:

a control device that performs a process of generating an envelope indicating a change in a reference value over time based on a waveform that indicates vibration of the first playing operation element, wherein the reference value is for determining whether vibration of the second playing operation element is self-induced vibration or excited vibration entailed by the vibration of the first playing operation element, wherein when the vibration of the second playing operation element is determined by the reference value, the control device performs a process of preventing first information on a basis of the excited vibration of the second playing operation element from being included in second information that indicates the self-induced vibration of the second playing operation element through using the reference value indicated by the envelope.

9. The information processing device according to claim 8, wherein the envelope indicates an increase in the reference value during a first period from a starting time point to a first time point and indicates a decrease in the reference value during a second period from the first time point to an ending point.

10. The information processing device according to claim 9, at every predetermined time point, the control device compares a level of a waveform indicating vibration of the second playing operation element and a comparison target level set by adding the reference value at a corresponding time point indicated by the envelope to a threshold, and the control device scans a waveform exceeding the comparison target level and does not scan any waveform not exceeding the comparison target level.

11. The information processing device according to claim 9, wherein a value of the reference value at the starting time point is a value obtained by multiplying a largest vibration value at the first time point by a predetermined coefficient.

12. The information processing device according to claim 8, wherein the electronic musical instrument is an electronic percussion instrument, and wherein the first playing operation element and the second playing operation element are a first percussive surface and a second percussive surface, respectively.

13. The information processing device according to claim 12, wherein the second percussive surface is directed in a direction opposite to a direction of the first percussive surface.

14. The information processing device according to claim 13, wherein the first percussive surface is joined to the second percussive surface with a joint part therebetween.

15. Info nation processing method performed by a control device of an electronic musical instrument comprising a first playing operation element and a second playing operation element, the information processing method comprising:

generating an envelope indicating a change in a reference value over time based on a waveform indicating vibration of the first playing operation element, wherein the reference value is for determining whether vibration of the second playing operation element is self-induced vibration or excited vibration entailed by vibration of the first playing operation element, and wherein when the vibration of the second playing operation element is determined by the reference value, performing a process of preventing first information on a basis of the excited vibration of the second playing operation element from being included in second information that indicates the self-induced vibration of the second playing operation element through using the reference value indicated by the envelope.

16. The information processing method according to claim 15, wherein the envelope indicates an increase in the reference value during a first period from a starting time point to a first time point and indicates a decrease in the reference value during a second period from the first time point to an ending point.

17. The information processing method according to claim 16, at every predetermined time point, the control device compares a level of a waveform indicating vibration of the second playing operation element and a comparison target level set by adding the reference value at a corresponding time point indicated by the envelope to a threshold, and the control device scans a waveform exceeding the comparison target level and does not scan any waveform not exceeding the comparison target level.

18. The information processing method according to claim 16, wherein a value of the reference value at the starting time point is a value obtained by multiplying a largest vibration value at the first time point by a predetermined coefficient.

19. The information processing method according to claim 15, wherein the electronic musical instrument is an electronic percussion instrument, and wherein the first playing operation element and the second playing operation element are a first percussive surface and a second percussive surface, respectively.

20. The information processing method according to claim 19, wherein the second percussive surface is directed in a direction opposite to a direction of the first percussive surface.

* * * * *